US010716338B2

(12) United States Patent
Witek et al.

(10) Patent No.: US 10,716,338 B2
(45) Date of Patent: Jul. 21, 2020

(54) MOVEMENT-REACTIVE ATHLETIC APPAREL AND METHODS OF MAKING THE SAME

(71) Applicants: Reebok International Limited, London (GB); STF Technologies LLC, Newark, DE (US)

(72) Inventors: Danielle Marie Witek, Milton, MA (US); Richard Dombrowski, Newark, DE (US); Norman Joseph Wagner, Newark, DE (US)

(73) Assignees: Reebok International Limited, London (GB); STF Technologies LLC, Newark, DE (US)

( * ) Notice: Subject to any disclaimer, the term of this patent is extended or adjusted under 35 U.S.C. 154(b) by 0 days.

(21) Appl. No.: 16/369,605

(22) Filed: Mar. 29, 2019

(65) Prior Publication Data

US 2019/0216141 A1 Jul. 18, 2019

Related U.S. Application Data

(63) Continuation of application No. 15/478,985, filed on Apr. 4, 2017, now Pat. No. 10,244,801.

(51) Int. Cl.
*A41C 3/00* (2006.01)
*A41C 3/12* (2006.01)
(Continued)

(52) U.S. Cl.
CPC ..... *A41C 3/0057* (2013.01); *A41C 3/0028* (2013.01); *A41C 3/0071* (2013.01);
(Continued)

(58) Field of Classification Search
CPC ..... A41C 3/00; A41C 3/0057; A41C 3/0028; A41C 3/0071; A41C 3/12; A41C 5/00; A42B 1/14; A42B 5/00
(Continued)

(56) References Cited

U.S. PATENT DOCUMENTS 7,381,460 B2 6/2008 Palmer et al.
7,794,827 B2 9/2010 Palmer et al.
(Continued)

FOREIGN PATENT DOCUMENTS

GB 2 441 639 A 3/2008
WO WO 97/00275 A2 1/1997
WO WO 2005/000966 A1 1/2005

OTHER PUBLICATIONS

Extended European Search Report issued in European Patent Application No. 18165599.4-1017, dated Jul. 30, 2018, 9 pages.

*Primary Examiner* — Gloria M Hale
(74) *Attorney, Agent, or Firm* — Sterne, Kessler, Goldstein & Fox P.L.L.C.

(57) ABSTRACT

Articles of athletic garments, particularly sports bra and methods of treating the athletic garments with a shear thickening fluid (STF) are disclosed. The athletic garment comprises a STF treated fabric. The STF treated fabric in contact with the wearer's body part restricts movement of the body part when the shear stress exceeds the shear stress threshold value and stretches and conforms to the wearer's body part when the shear stress is less than the shear stress threshold value. The STF treatment method may include immersing the untreated fabric in a diluted STF bath, metering an amount of the fluid on the fabric, and removing the diluent from the treated fabric.

19 Claims, 17 Drawing Sheets

(51) Int. Cl.
*A41C 5/00* (2006.01)
*A43B 5/00* (2006.01)
*A43B 1/14* (2006.01)

(52) U.S. Cl.
CPC ..... *A41C 3/12* (2013.01); *A41C 5/00* (2013.01); *A43B 1/14* (2013.01); *A43B 5/00* (2013.01); *A41B 2400/22* (2013.01); *A41B 2500/52* (2013.01)

(58) Field of Classification Search
USPC ..... 450/80, 81
See application file for complete search history.

(56) References Cited

U.S. PATENT DOCUMENTS 9,480,287 B2 * 11/2016 Black ..... A41C 3/0057
9,516,905 B2 12/2016 Pagnon
10,244,801 B2 * 4/2019 Witek ..... A41C 3/0057
10,448,678 B2 * 10/2019 Randall ..... A41C 3/0057
2005/0037189 A1 2/2005 Palmer et al.
2006/0183852 A1 8/2006 Liu et al.
2007/0029690 A1 2/2007 Green et al.
2008/0189983 A1 8/2008 Frederick
2008/0268748 A1 10/2008 Huang et al.
2009/0255023 A1 10/2009 Williams et al.
2009/0300949 A1 12/2009 Frederick et al.
2009/0324927 A1 12/2009 Palmer et al.
2012/0121876 A1 5/2012 Milesi
2013/0160638 A1 6/2013 Allison
2014/0259326 A1 9/2014 Carlson
2016/0021947 A1 1/2016 Dor-El et al.
2016/0044971 A1 2/2016 Randall et al.
2016/0309808 A1 10/2016 Armour et al.
2018/0027969 A1 * 2/2018 Choi ..... A47C 1/031
2019/0216141 A1 * 7/2019 Witek ..... A41C 3/0028

* cited by examiner

MOVEMENT-REACTIVE ATHLETIC APPAREL AND METHODS OF MAKING THE SAME

RELATED APPLICATIONS AND PATENTS

The present application is a continuation of U.S. patent application Ser. No. 15/478,985, filed on Apr. 4, 2017, now U.S. Pat. No. 10,244,801.

BACKGROUND

Field of the Invention

The described embodiments generally relate to athletic articles, and more particularly to a movement reactive sports bra and methods of making the same.

Background Art

Many individuals, especially women, use sports or exercise bras to provide breast support and to reduce breast movement during physical activity in order to limit associated physical or mental issues. Adequate breast and back support for women is desirable as reducing excessive movement of soft tissue allows for painless and distraction-free physical functioning of the human body and prevents damage that might otherwise afflict the breasts.

A lack of skeletal support for women's breast tissue leads to undesired breast movement or bounce, creating a strain between the skeletal system and the soft tissue moving out of sync of one another. This conflicting movement within the body may cause internal damage, back strain, and shoulder pain and/or otherwise strain the breast tissues, causing damage that may be permanent. While such stresses may be distributed over the entire breast as a whole, repetitive movement due to lack of support can cause a person to avoid exercise or lead to permanent damage of the breast tissue. Such stresses often occur during exercise such as aerobics, horseback riding, running, or jogging.

Accordingly, a well-fitting, fully supportive, sports bra is a necessary part of women's fitness uniform and a continuous need exists for innovation in athletic garments such as sports bras.

Proper supporting sports bras should support breast tissue from damage at all times during the physical activity to avoid irritation, chaffing, and cutting into the skin and support the breasts with a good fit during a resting or relaxed state. Additionally desirable qualities include durability, comfort, breathability, easy-to-use design and other qualities that provide other beneficial characteristics for an individual.

SUMMARY

Some embodiments are directed towards a sports bra comprising a front section configured for covering at least a portion of a wearer's anterior torso wherein the front section comprises a non-planar region for supporting a wearer's breasts and a rear section configured for covering at least a portion of the wearer's posterior torso. At least one of the front and rear sections further comprise a fabric treated with a shear thickening fluid (STF), wherein the shear thickening fluid comprises particles dispersed in a fluid medium that exhibits a shear thickening material response.

In some embodiments, the sports bra comprises particles selected from a group consisting of silicon dioxide, titanium dioxide, calcium carbonate and polymers. In some embodiments, the size of the particles ranges from 5 nm to 50 um. In some embodiments, the concentration of particles in the fluid medium ranges from 5% to 90% by weight.

In some embodiments, the entire front section of the sports bra comprises the fabric treated with the shear thickening fluid. In some embodiments, the entire rear section of the sports bra comprises the fabric treated with the shear thickening fluid.

In some embodiments, the sports bra further comprises a pair of shoulder straps extending upwardly from the non-planar region, wherein the pair of shoulder straps are treated with the shear thickening fluid.

In some embodiments, the sports bra further comprises a bottom band encircling the wearer's torso below the wearer's breasts, such that the bottom band connects the front and the rear sections along a girth of the wearer's torso.

In some embodiments, the front and the rear sections of the sports bra are connected along a frontal plane parallel to a longitudinal axis of the wearer's torso. The front and the rear sections of the sports bra may be connected using a method selected from the group consisting of stitching, zipping, gluing, snaps, hook-and-eye, and hook-and-loop.

In some embodiments, the fabric of the sports bra may be selected from the group consisting of cotton, polyester, nylon, spandex and combinations thereof.

Some embodiments are directed towards an article of sportswear, the article comprising a fabric treated with a shear thickening fluid having a shear stress threshold value above which the fluid shear thickens, wherein the shear thickening fluid comprises particles dispersed in a fluid medium. The treated fabric when secured on a wearer's body part comprises a first portion of the treated fabric in direct contact with the wearer's body part for supporting the wearer's body part, wherein the first portion of the treated fabric stretches and conforms to the wearer's body part when a shear stress in the first portion of the treated fabric is below the shear stress threshold value; and the first portion of the treated fabric restricts movement of the wearer's body part when the shear stress in the first portion of the treated fabric is above the shear stress threshold value. The treated fabric when secured on a wearer's body part comprises a second portion of the treated fabric not in direct contact with the wearer's body part.

In some embodiments, the article of sportswear is a sports bra or an article of footwear.

In some embodiments, the article of sportswear comprises particles selected from the group consisting of silicon dioxide, titanium dioxide, calcium carbonate, and polymers. The size of the particles ranges from 5 nm to 50 um. The concentration of the particles in the fluid medium ranges from 5% to 90% by weight. The fluid medium is selected from a group consisting of glycols, silicone oils, and hydrocarbon fluids. In some embodiments, the fluid medium may be polyethylene glycol and phenylmethyl silicone oil.

Some embodiments are directed towards a method of treating an athletic garment with a shear thickening fluid, the method comprising dispersing particles in a fluid medium to form a suspension, wherein the suspension comprises a shear thickening fluid. The formed suspension is diluted with a diluent to form a diluted shear thickening fluid. The athletic garment is intercalated with the diluted shear thickening fluid and the diluent is removed from the athletic garment intercalated with the diluted shear thickening fluid to form the athletic garment treated with the shear thickening fluid.

In some embodiments, the ratio of the diluent to the suspension in the diluted shear thickening fluid ranges from 1:1 to 10:1.

In some embodiments, the athletic garment is a sports bra.

DETAILED DESCRIPTION

Figure 1A:
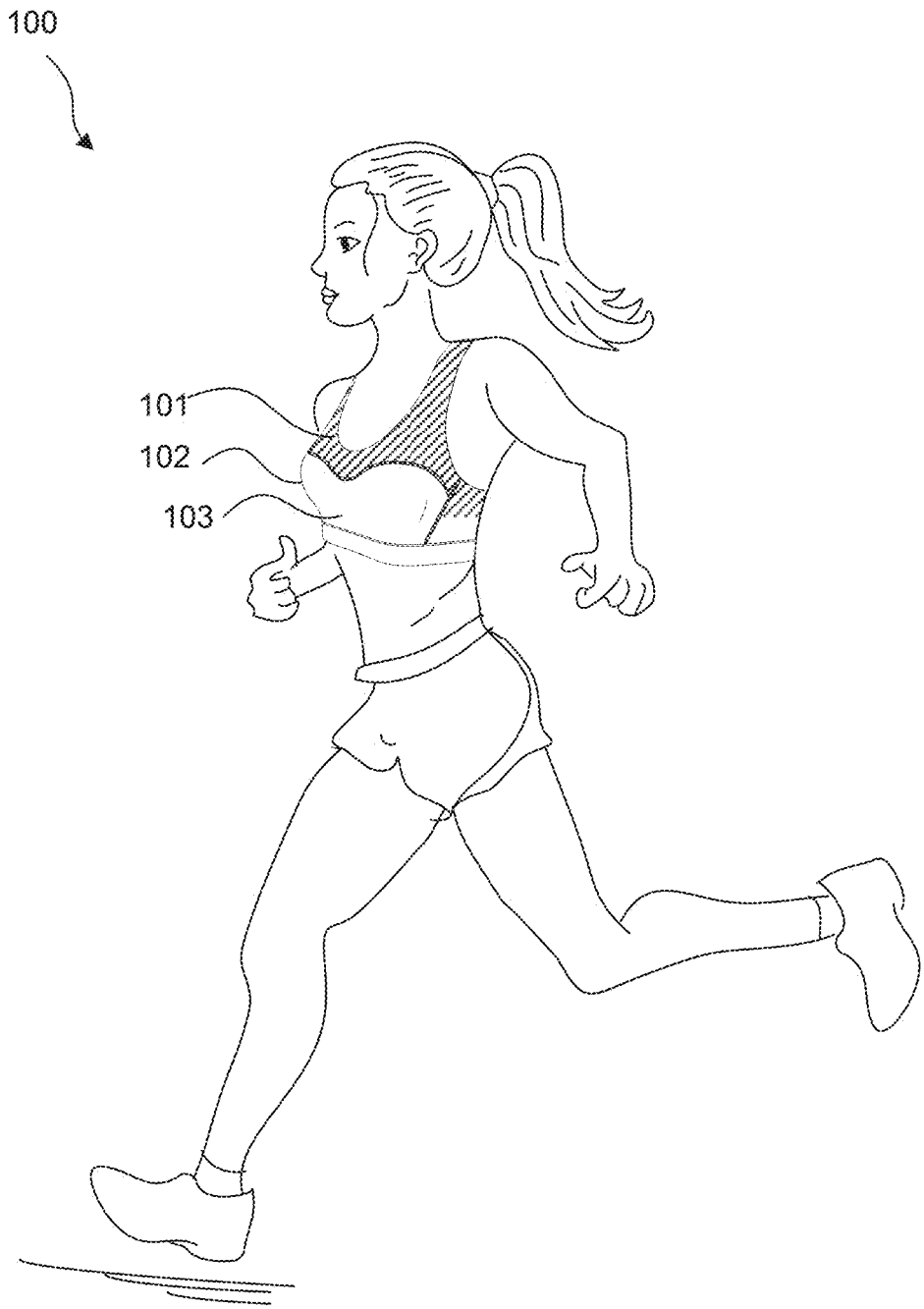
FIG. 1A illustrates a user wearing a sports bra according to an embodiment.

The present invention(s) will now be described in detail with reference to embodiments thereof as illustrated in the accompanying drawings. References to "one embodiment", "an embodiment", "an exemplary embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

Physical activity, in men and women alike, not only lowers body fat levels through changes in metabolic rate, but also results in many physical and psychological benefits such as improvements in cardiovascular fitness and overall well-being. Other important health benefits have been reported as a result of women participating in physical activity. For example, some forms of physical activity can decrease injury rates as participating in weight bearing exercise, in combination with adequate estrogen levels, can increase bone strength.

In addition, psychological well-being and physical activity have also been linked. A significant relationship between participating in physical activity and a high level of emotional well-being in older women, for example, is also known. Reduced physical activity levels are known to affect emotional well-being of most individuals.

Some individuals refrain from participating in rigorous physical activities due to the pain caused by damage to the soft-tissue attributed to lack of adequate support and movement restriction. In the sports apparel industry, an apparent need exists for articles of sportswear that limit excessive movement of the soft-tissue while performing rigorous physical activities including adequately supporting the soft-tissue during the absence of, or reduced amount of, such rigorous activity.

For example, some individuals refrain from participating in physical activity due to the pain and/or embarrassment associated with excessive breast motion. As the female breast contains no supportive muscle or bone, breast tissue is relatively free to move over the chest wall, especially during motion of the torso, such as that which occurs during physical activity. In some instances, the skin provides most of the anatomical support for the breast and the thin bands of fibrous tissue that divide the breast lobules and attach to the deep fascia of the pectoralis muscles, known as Cooper's Ligaments, can play a major role in breast support. The thin fibrous structure of Cooper's Ligaments is only likely to provide limited support to the breast structure. Furthermore, as other anatomical support to the female breast is limited, the Cooper's Ligaments can be easily stretched due to repetitive mechanical loading associated with breast bounce, which may in turn lead to breast sag. Therefore, external breast support is required to reduce breast motion associated with participating in physical activity.

Although breast motion is limited most effectively when a bra firmly holds the breast tissue close to the body, there is a need for sufficient elasticity in the horizontal plane and comfort in the vertical plane, to allow the chest to expand during respiration.

Although the use of an encapsulating sports bra during physical activity may reduce breast motion and associated breast discomfort, encapsulating sports bras have disadvantages when used during rigorous physical activity. An apparent need exists for sports bras that are fully supportive yet comfortable and that serve a wide variety of women with different breast sizes and shapes.

Some embodiments of the present disclosure describe a movement-reactive article of sportswear configured to provide varying levels of support commensurate to the movement of soft-tissue of the wearer's body while performing a physical activity. The movement-reactive article of sportswear includes a fabric treated with a shear thickening fluid (STF). The movement-reactive article of sportswear provides adequate support to the wearer's body part by allowing uninhibited stretching of the STF treated fabric in direct contact with the wearer's body part while the wearer is performing "non-rigorous" physical activities or in a resting state. "Non-rigorous" physical activities, as referred to herein, may include activities that do not result in excessive soft-tissue movement such as, but not limited to, walking, yoga, etc. Contrastingly, the movement-reactive article of sportswear restricts the movement of the wearer's soft-tissue in direct contact with the STF treated fabric while the wearer is performing rigorous physical activities such as, but not limited to, running, horseback riding, swimming, tennis, soccer, and similar physical activities.

Figure 1B:
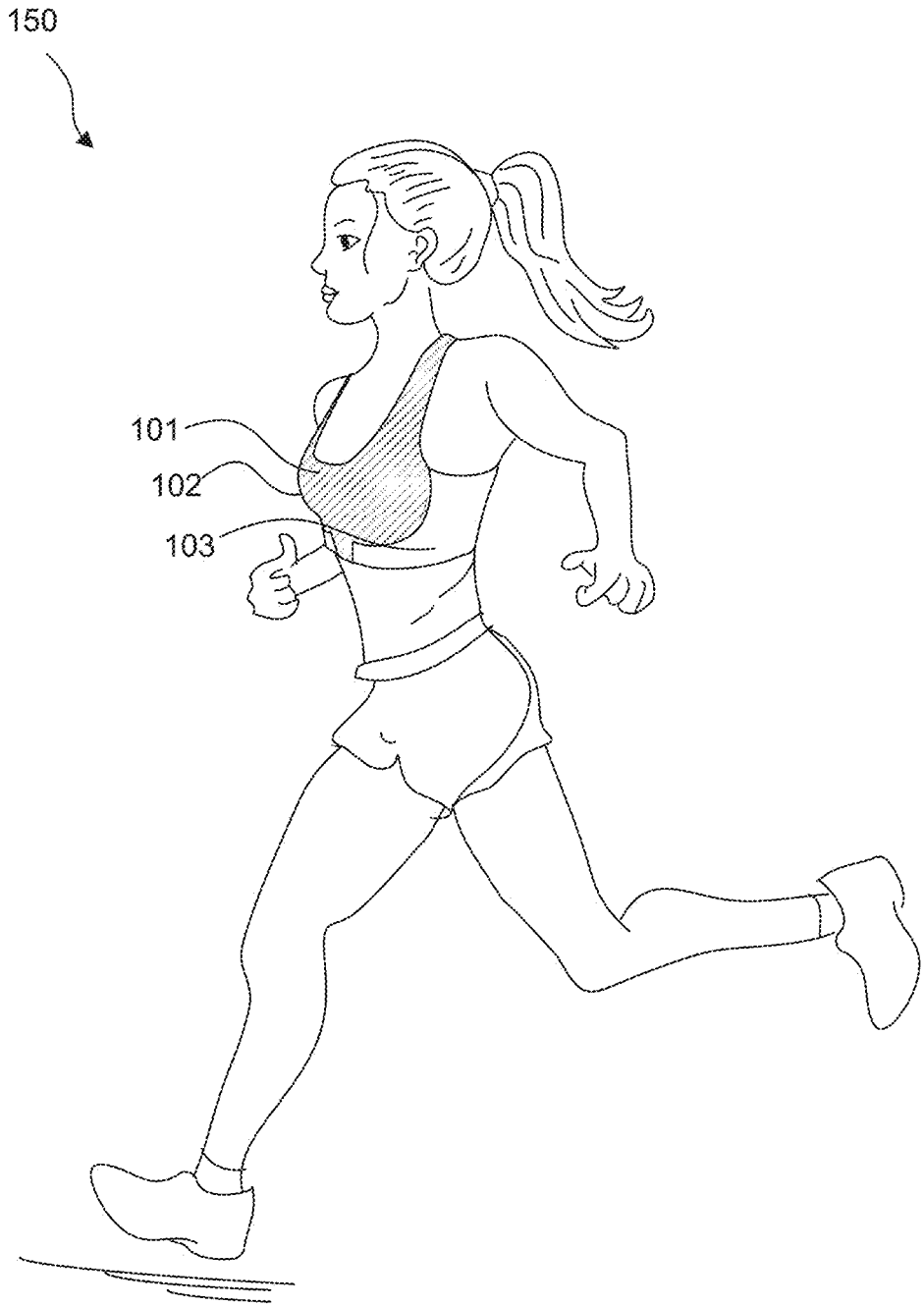
FIG. 1B illustrates a user wearing a sports bra according to an embodiment.

With reference to a view 100 in FIG. 1A, in some embodiments, the movement-reactive article of sportswear may be a movement-reactive sports bra 102 worn by an individual while engaging in a physical activity, such as running. It will be appreciated that in other embodiments, the movement-reactive article of sportswear may comprise a shirt, a pant, a short pant, underwear, an article of footwear, or other fitness garment. In some embodiments, the movement-reactive article of sportswear, such as the movement-reactive sports bra 102 may include an STF treated portion 101, that includes an STF treated fabric, and an untreated portion 103. In some embodiments, the entire article may be treated. FIG. 1B illustrates a view 150, of an individual wearing a movement-reactive sports bra 102, while engaging in a physical activity, such as running. The movement-reactive sports bra 102 in FIGS. 1A and 1B illustrate design variations with respect to portions of the sports bra that may be treated with the STF.

In some embodiments, as described herein, the knit structure of the treated movement-reactive sports bra 102 relaxes and stretches at a resting state but then restricts at various levels based on the needs and activity level of the wearer. The transition from stretching to restricting may occur in milliseconds on a nano-scale such that it is invisible to the naked eye. In some embodiments, the fabric may be loosely or densely knitted. The densely knitted fabric may help with the absorption of the shear thickening fluid and the shearing action of the knit structure of the fabric.

In one embodiment, the shear thickening fluid (STF) is a suspension that comprises particles dispersed in a fluid medium. The STF may comprise non-Newtonian fluids that exhibit a dramatic increase in viscosity when the shear stress is above a threshold value. At shear stress lower than the shear threshold value, the fluid has low viscosity and flows easily; however at shear stress above the shear threshold value, the hydrodynamic forces overcome repulsive inter-particle forces and hydroclusters may be formed. Lubrication hydrodynamics within these hydroclusters lead to increased energy dissipation and thus higher viscosity.

In some embodiments, portions of the movement-reactive sports bra 102 are treated with STF, such that the movement-reactive sports bra, when secured on the wearer's body, provides maximum support to the wearer's breasts, shoulders and/or back. The shear stress generated during physical activity causes shear thickening of the treated portions of the fabric in direct contact with the wearer's body part while during the resting state, the fabric stretches to conform to the contours of the wearer's body, providing a comfortable fit.

In some embodiments, the fabric of the STF treated movement-reactive sports bra 102 may be any natural or synthetic material, cotton, polyester, nylon, spandex (lycra) or a combination thereof. In some embodiments, the fabric may comprise various kinds of textiles. The ratios of various kinds of textiles in the fabric may be determined by the desired characteristics such as, for example, breathability, comfort, stretchability, moisture-wicking, and other performance related characteristics. In some embodiments, the STF treated fabric may comprise a combination of polyamide (PA) and Elastane (EA).

In one embodiment, the fabric material comprises a combination of 73% PA and 27% EA. Other combinations of ratios, materials, weight, knit-type, etc. may be used.

Figure 2:
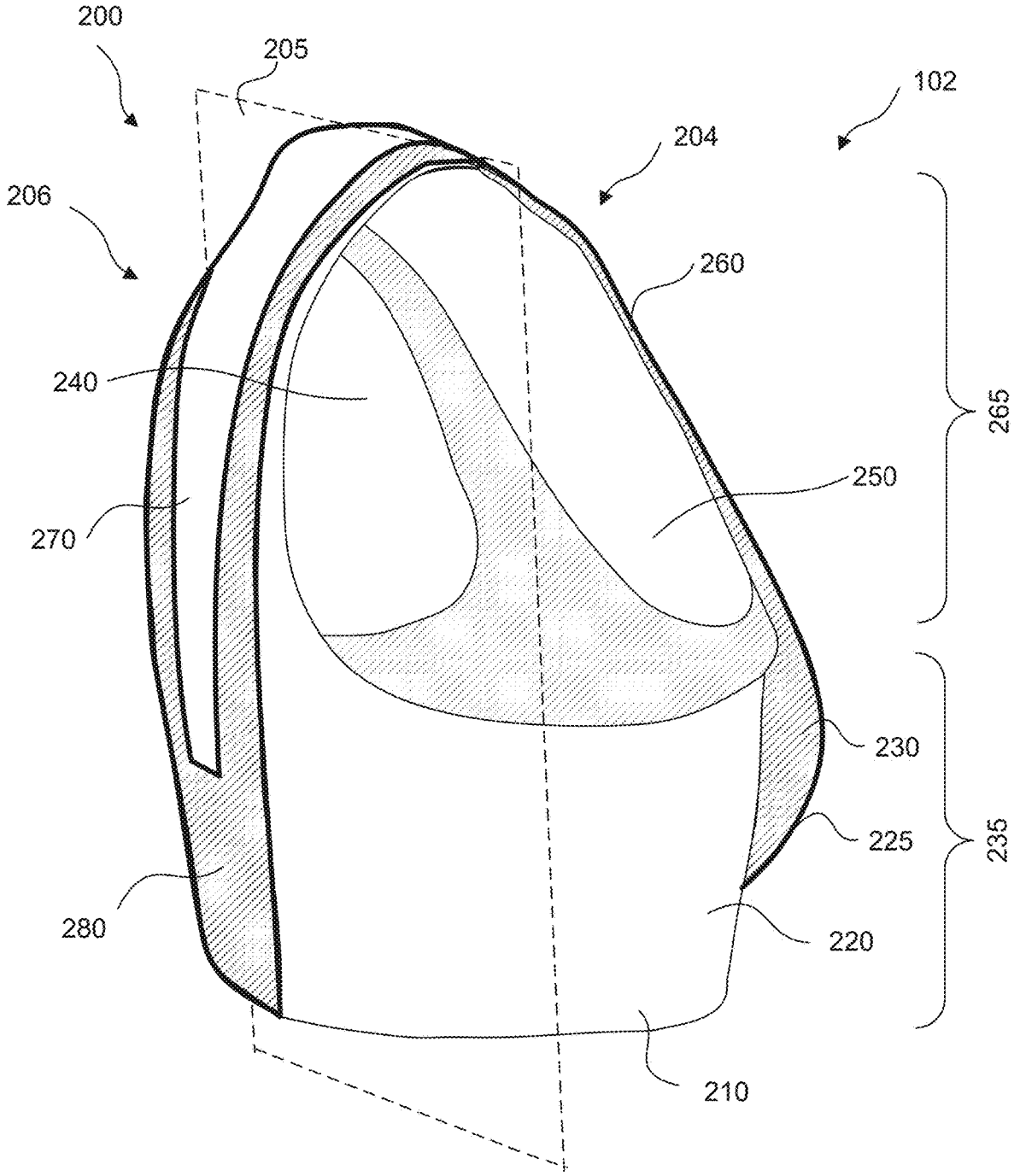
FIG. 2 is a perspective side view of an STF treated sports bra according to an embodiment.
Figure 3:
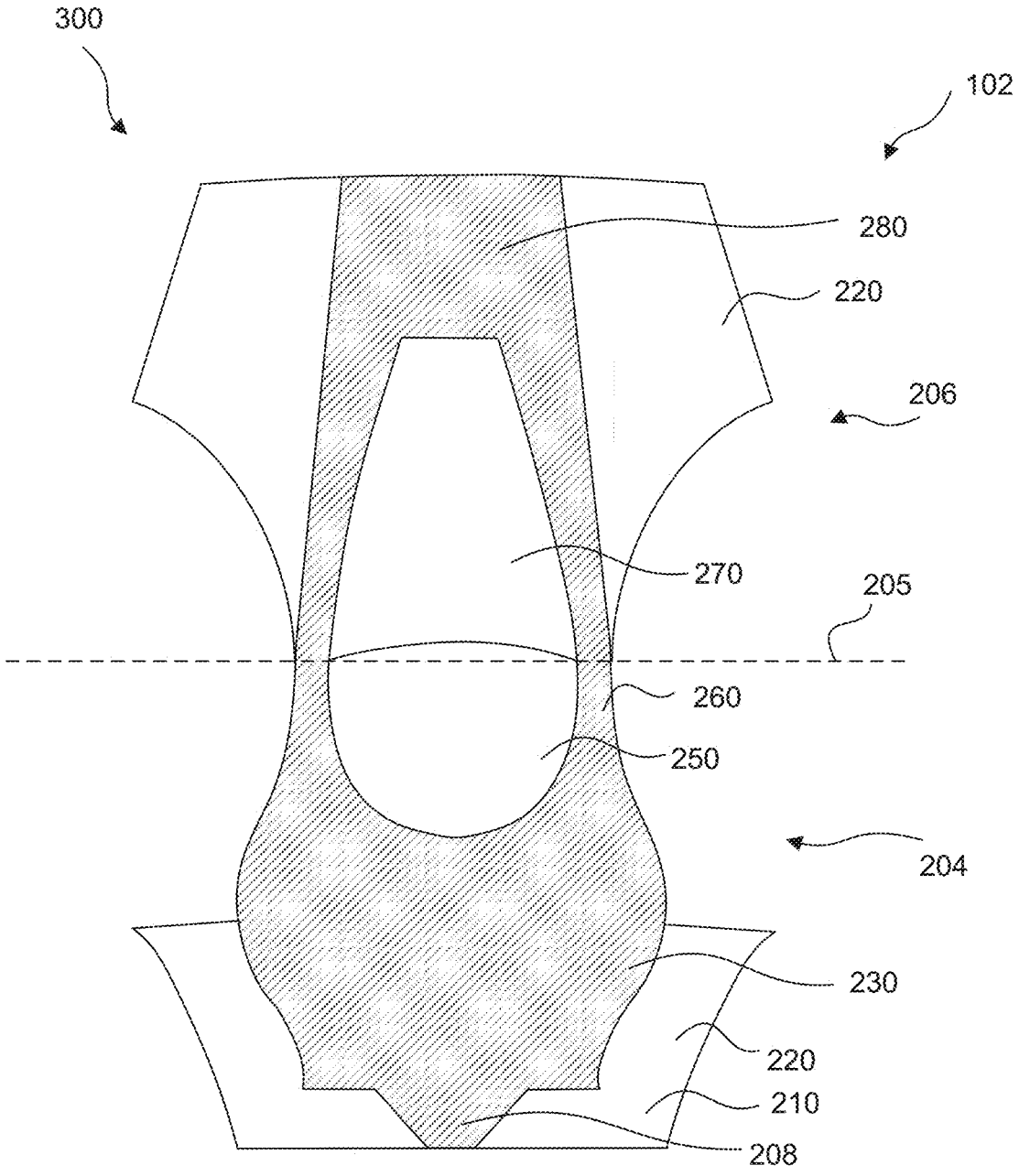
FIG. 3 is a split-open top view of an STF treated sports bra along a frontal plane according to an embodiment.

In some embodiments, as shown in FIGS. 2 and 3, the STF treated movement-reactive sports bra 102 comprises a front section 204 configured for covering at least a portion of a wearer's anterior torso, and a rear section 206, configured for covering at least a portion of the wearer's posterior torso, when worn by the wearer. A virtual frontal plane 205, also known as the coronal plane, differentiates the front section 204 and the rear section 206.

As illustrated in FIG. 2, the front section 204 of the STF treated movement-reactive sports bra 102 comprises a frontal upper end 265 and a frontal lower end 235. The front section 204 further comprises a non-planar region 230 configured for supporting the wearer's breasts. In some embodiments, the non-planar region 230 is a continuous, seamless panel or a laminated pad. In some embodiments, the non-planar region 230 may not be seamless.

Figure 4:
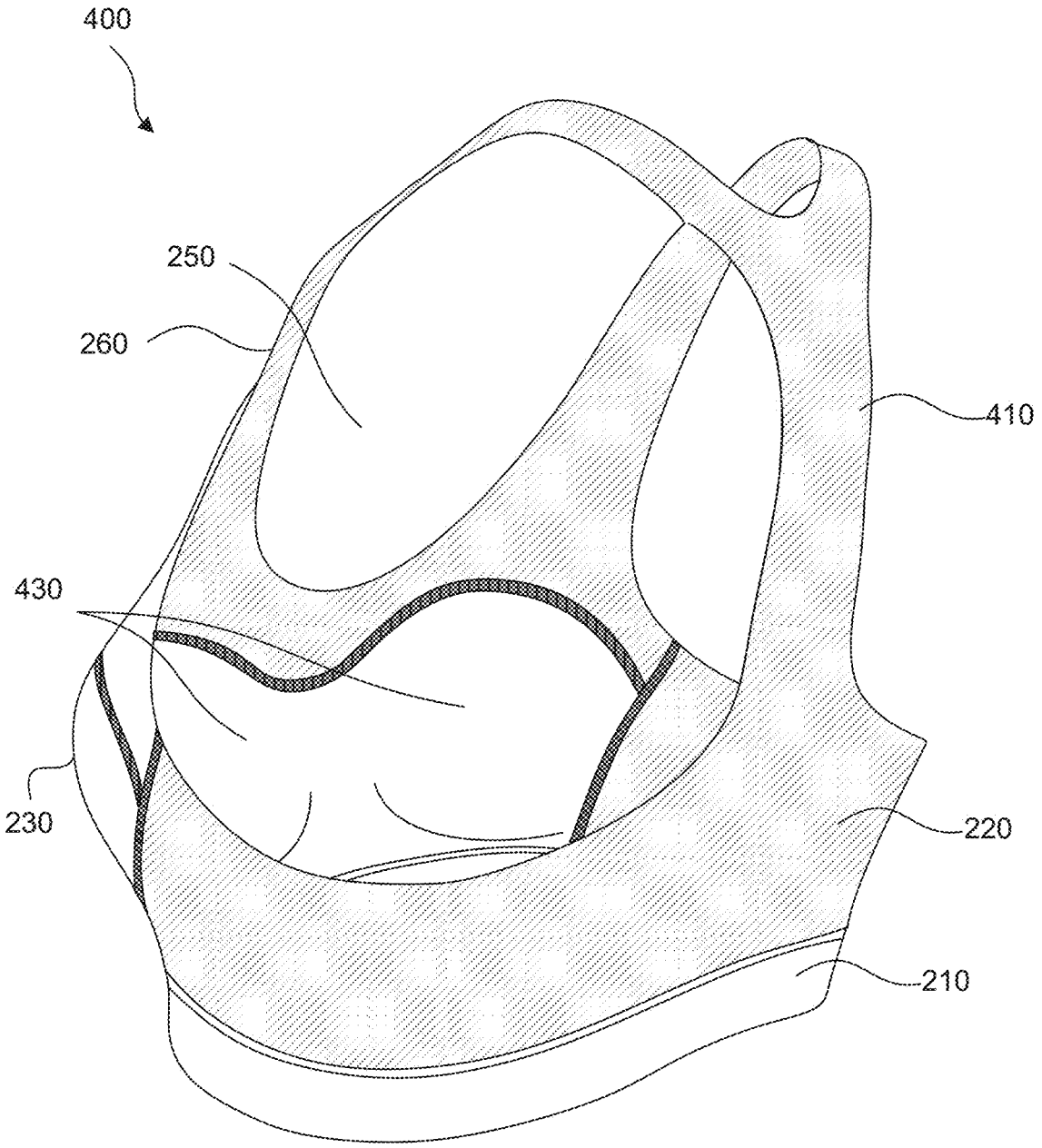
FIG. 4 is a perspective side view of an STF treated sports bra according to an embodiment.

In some embodiments, the non-planar region 230 may comprise a pair of cups, wherein the left cup supports the left breast and the right cup supports the right breast of the wearer. In some embodiments, the non-planar region 230 may comprise a pair of molded cups 430, as illustrated in FIG. 4. The pair of cups may comprise removable cups, molded cups, or combinations thereof. Other suitable cup types and designs may be used.

In some embodiments, the non-planar region 230 encapsulates the breasts of the wearer in their entirety to maximize the support by restricting their movement in multiple directions including the upward, downward or side directions, or combinations thereof.

In some embodiments, the frontal upper end 265 of the front section 204 comprises a pair of shoulder straps 260 and a neck hole 250. The shoulder straps 260 extend upwardly from the non-planar region 230 over the shoulders of the wearer, connecting the front section 204 and the rear section 206 of the STF treated movement-reactive sports bra 102.

In some embodiments, as illustrated in FIG. 2, the shoulder straps 260 and the non-planar region 230 are treated with STF to control various levels of material stretch and strain along maximum impact zones. In some embodiments, only a portion of the shoulder straps 260 and the non-planar region 230 may be treated with STF, determined by the level of support needed, level of activity performed, and/or the level of comfort desired. In some embodiments, the shoulder straps may not be treated with the STF. In some embodiments, the shoulder straps 260 are treated with the STF and the non-planar region 230 may not be treated with the STF. In some embodiments, the entire front section 204 may be treated with the STF.

In some embodiments, the movement-reactive sports bra 102 comprises an apex portion of the bra configured to connect the shoulder straps 260 with the non-planar region 230. The apex portion of the movement-reactive sports bra 102 may be treated with the STF. In some embodiments, the apex portion of the movement-reactive sports bra 102 may not be treated with the STF.

The rear section 206 is configured for covering a portion of the wearer's posterior torso and comprises a rear upper end 270 and a rear lower end 280. FIG. 2 illustrates an exemplary movement-reactive sports bra 102 wherein a portion of the rear lower end 280 is treated with STF and a portion of the rear upper end 270 is not treated with STF. In some embodiments, the entire rear section 206 may be treated with the STF.

In some embodiments, the rear upper end 270 comprises a fabric configured to provide breathability and stabilization of shoulder straps 260 for maximum support to the wearer while engaged in rigorous or non-rigorous physical activity. The rear section 206 may comprise perforations adapted to provide breathability. A portion of the fabric comprising the rear upper end 270 may be STF treated or the entire rear upper end 270 may be treated with the STF.

In some embodiments, the STF treated bra 102 may include a coating 225 on the outer side of the treated fabric in contact with the air such that the coating prevents moisture and dirt particles from trapping into the knit or the woven fabric. The coating 225 may serve as a protective coating, decorative coating, water-repellent coating, biocompatible coating, antimicrobial or other suitable coatings. The moisture or dirt particles may affect the STF rendering the treated fabric ineffective or less effective for restricting the movement of the wearer's body part supported by the treated fabric in contact with the wearer's body part. In some embodiments, the coating 225 may help with the washability and retain the performance of the treated fabric.

In some embodiments, the coating materials may include silicones, silicone emulsions, polyurethanes, rubbers, and combination thereof. Other suitable coating materials may be used.

In some embodiments, the STF treated sports bra 102 comprises a bottom band 210 that may encircle the wearer's torso below the wearer's breasts, such that the bottom band connects the frontal lower end 235 and the rear lower end 280 along the girth of the wearer's torso. In some embodiments, the bottom band 210 connects the front section 204 and the rear section 206 along the girth of the wearer's torso. The bottom band may be configured to assist in shaping the under-bust for a better fit and anchoring. In some embodiments, a center front portion 208 of the bottom band 210 in the front section 204 of the sports bra 102 may be treated with STF. The STF treatment of the center front portion 208 portion of the bottom band 210 may provide extra support and anchoring of the non-planar region 230 and the shoulder straps 260 during physical activity. In some embodiments, the bottom band 210 may not be treated with the STF, as depicted in FIG. 4.

In some embodiments, the bottom band 210 may be an elastic band allowing for easy securing and removing of the sports bra and better comfort.

In some embodiments, the sports bra 102 further comprises a side panel 220 under each arm hole 240. In some embodiments, the bottom band 210 and the side panel 220 may be continuous and seamless. In some embodiments, the front section 204 and the rear section 206 of the STF treated sports bra 102 may be connected by stitching, zipping, snaps, gluing, hook-and-eye, hook-and loop, or a combination thereof. Other fastening and securing methods may be used.

A split-open top view 300 of an exemplary STF treated sports bra 102 along the frontal plane 205 is shown in FIG. 3. In some embodiments, the entire bra may be made from STF treated fabric. The front section 204 and rear section 206 comprise STF treated fabric at impact zones for maximum support and comfort during physical activity. The frontal plane 205, also referred to as the coronal plane of a wearer's body divides the body into an anterior (front) section and a posterior (rear) section. The side panels 220 may comprise untreated fabric for adjustable fit and comfort across the wearer's busts and at the bottom band 210. In some embodiments, the side panels 220 are treated with the STF. The untreated fabric may be stretchable fabric to allow for ease of on/off for the wearer.

Figure 5:
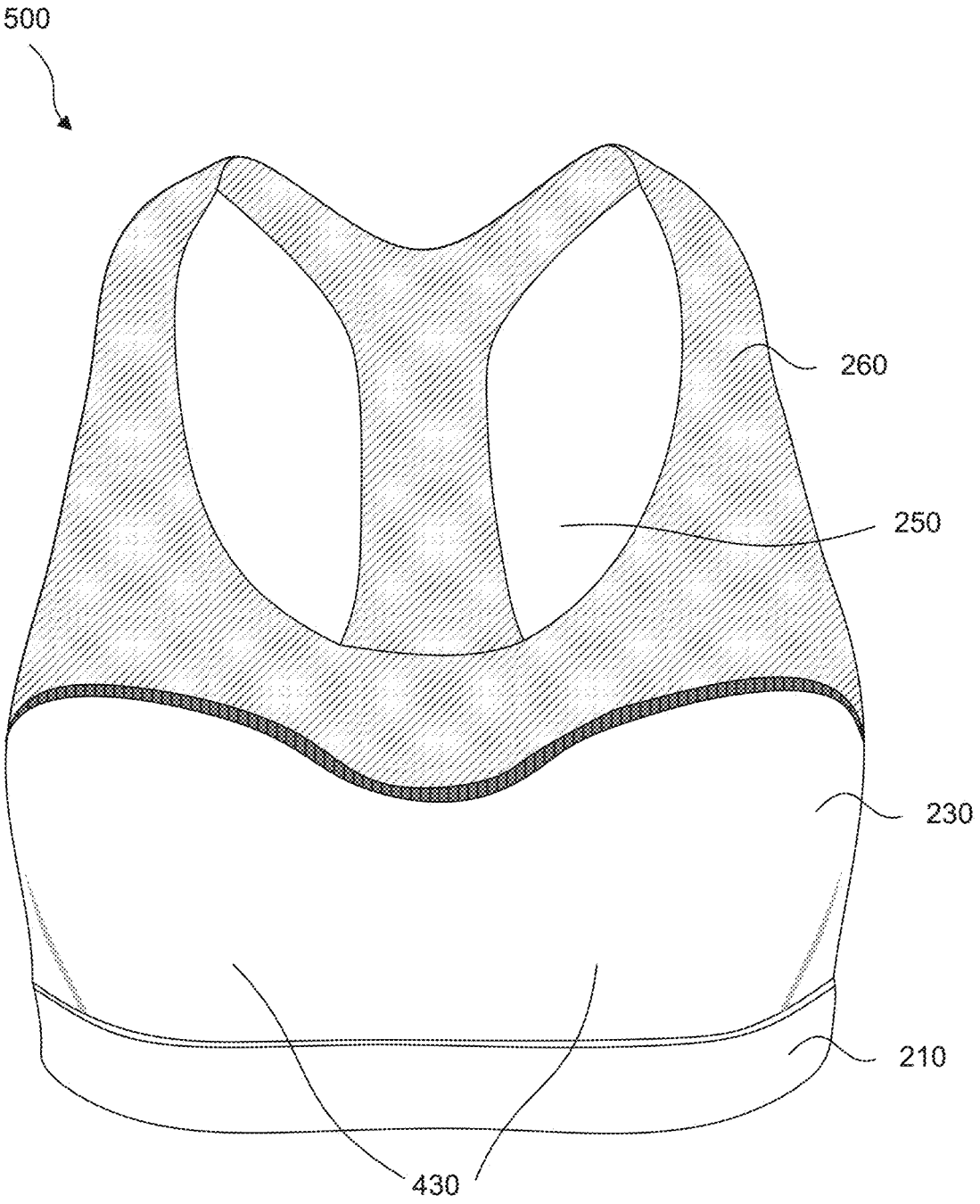
FIG. 5 is a front view of an STF treated sports bra according to an embodiment.
Figure 6:
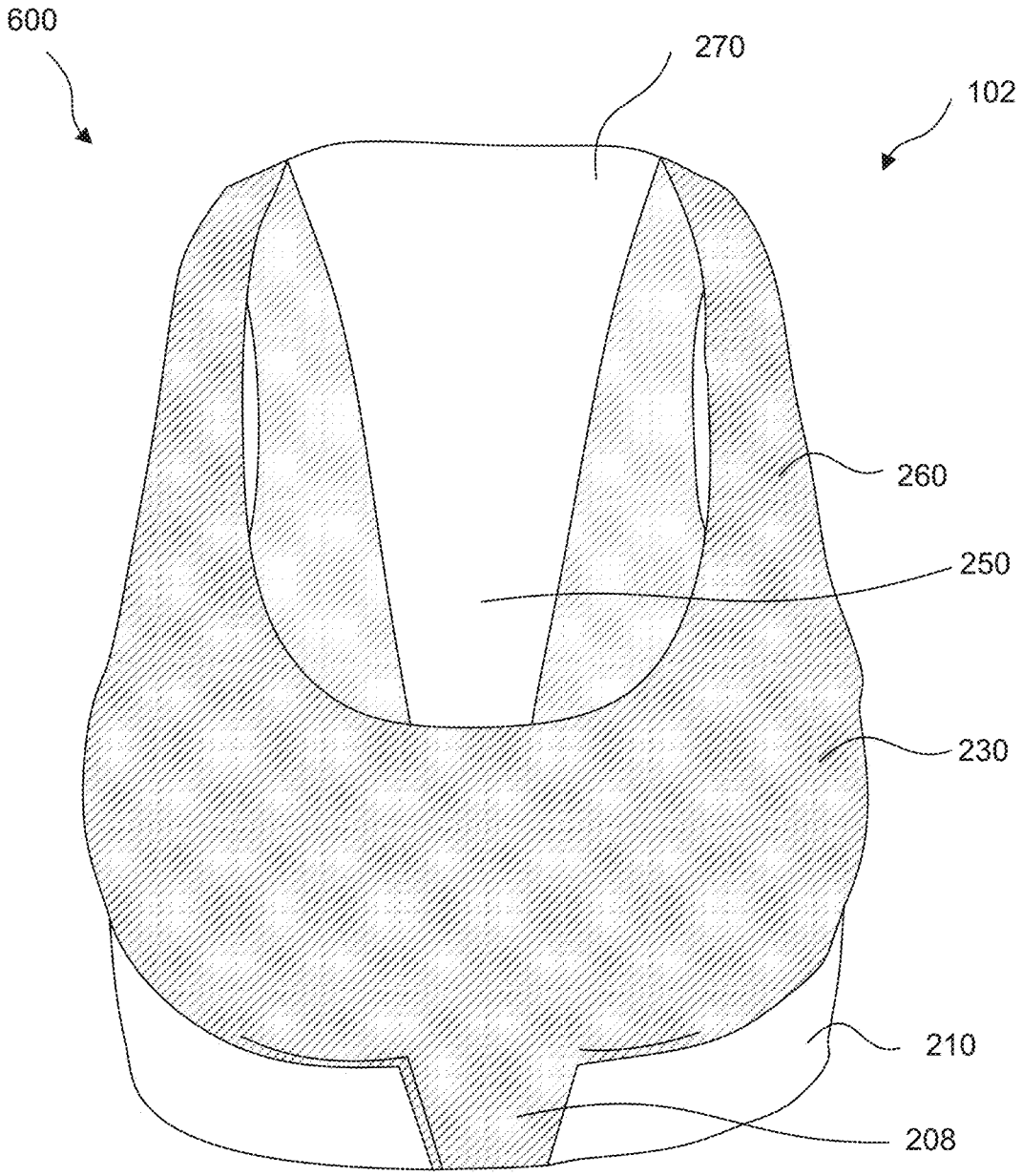
FIG. 6 is a front view of an STF treated sports bra according to an embodiment.
Figure 7:
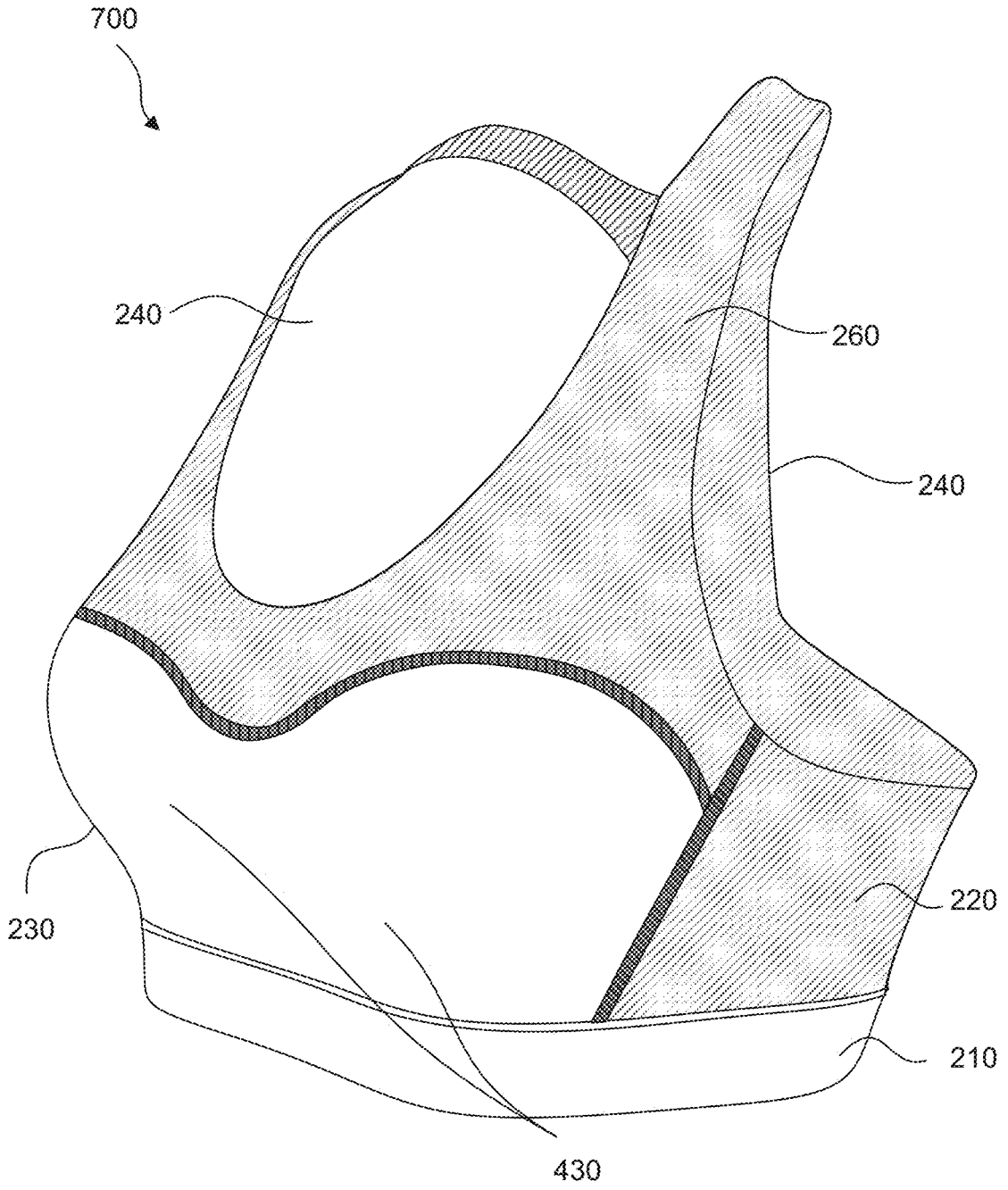
FIG. 7 is a perspective side view of an STF treated sports bra according to an embodiment.
Figure 8:
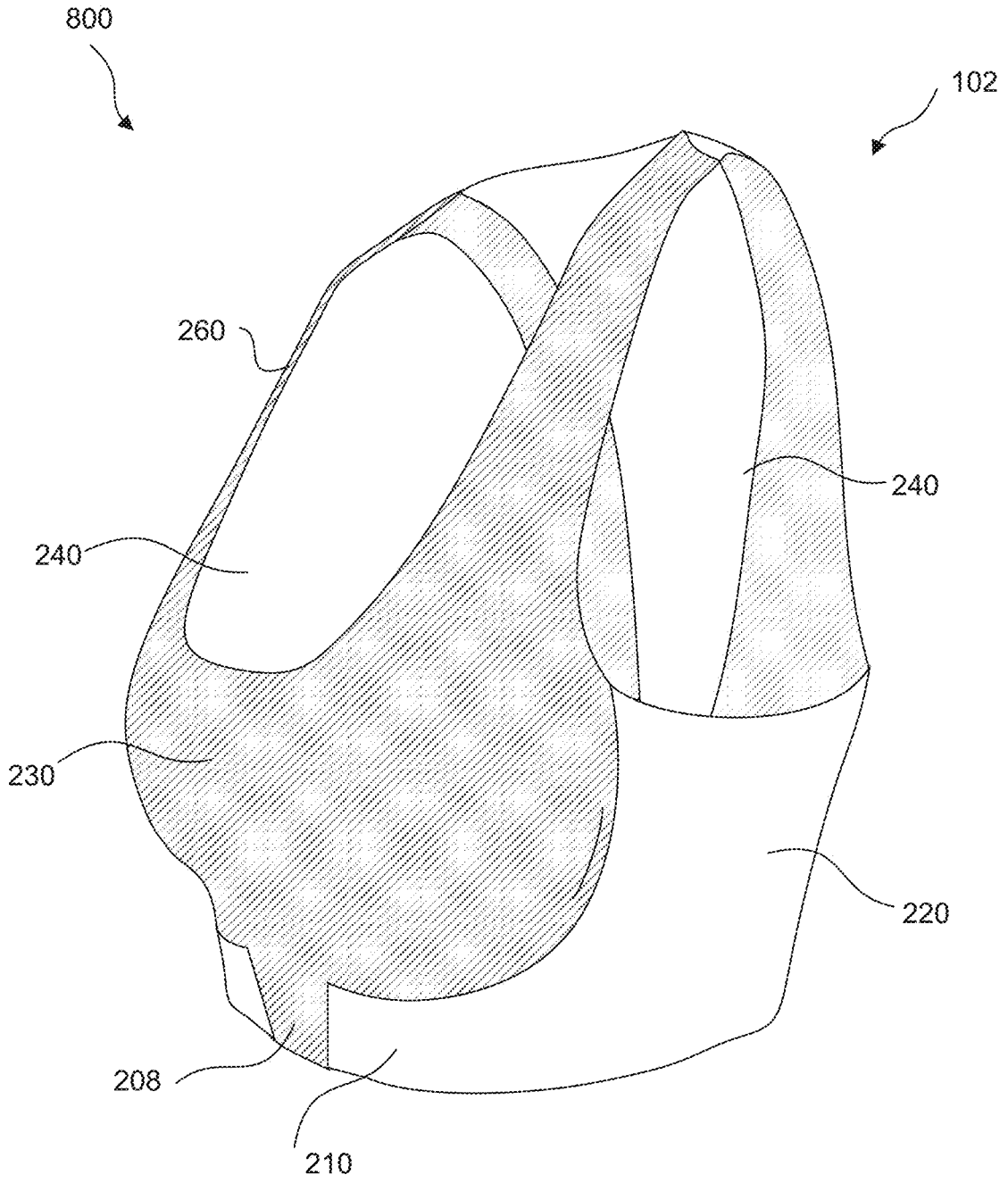
FIG. 8 is a perspective side view of an STF treated sports bra according to an embodiment.

FIGS. 5 and 6 show perspective front views 500 and 600, respectively, of an STF treated movement-reactive sports bra 102. The STF treated movement-reactive sports bra 102 may include a neck hole 250 defined by an area between the shoulder straps 260 in a horizontal direction along the frontal plane of the wearer's body, and the frontal upper end 265. FIGS. 7 and 8 show side views 700 and 800, respectively, of an STF treated movement-reactive sports bra 102, comprising a pair of arm holes 240, each armhole defined by an area between the front section 204 and the rear section 206 in a transverse direction along a sagittal plane of the wearer's body, and between the upper end of the side panel 220 and the point of the shoulder strap 260 in contact with the wearer's shoulder in a vertical direction parallel to the longitudinal axis of the wearer's body.

In some embodiments, the movement-reactive sports bra 102 may be designed so as to selectively treat portions of the movement-reactive sports bra 102 with the shear thickening fluid, configured to provide maximum support and control various levels of material stretch and strain along maximum impact zones in the upward and downward motion while engaging in a physical activity.

In some embodiments, the bottom band 210 and the non-planar region 230 comprising the molded cups 430 may not be treated with the STF, while the shoulder straps, apex, upper bust section, and the entire rear section comprise a fabric treated with the STF, as illustrated in the perspective view 700 of a movement-reactive sports bra 102 in FIG. 7. In some embodiments, the entire sports bra comprises fabric treated with the STF. In some embodiments, portions of the sports bra may be selectively treated with the STF based on the parameters comprising user's comfort level, activity level, desired protection and support.

Figure 16:
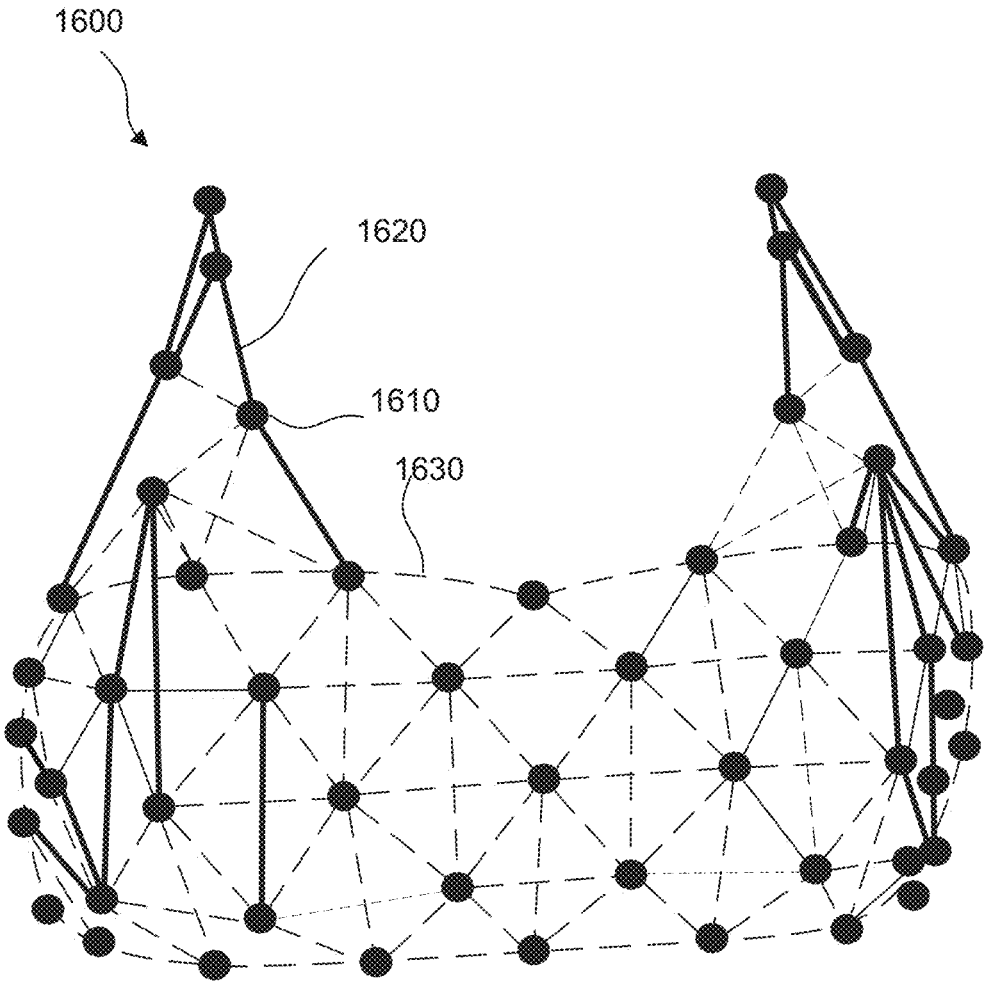
FIG. 16 represents a simulation of markers and link stretches for tracking stress and strain in an individual's breasts during a physical activity, according to an embodiment.

The amount of control or support needed by the fabric may be determined by breast biomechanics or soft-tissue biomechanics. FIG. 16 illustrates an exemplary biomechanics software simulation representation 1600 of the stress and strain generated in an individual's breast tissue, while engaging in a physical activity. In some embodiments, reflective markers 1610 may be used to obtain kinematic data of an individual engaged in a physical activity. Kinematic data, as referred to herein includes the spatial and temporal components of motion. The description of motion may involve the position, velocity, and acceleration of an individual's body with no consideration of the forces causing the motion.

In some embodiments, kinematic data may be obtained by using accelerometers or other suitable sensors that measure accelerations of body segments directly. Other suitable methods such as, for example, high-speed video tracking systems or opto-electronic motion capture systems may be used. The data obtained from high-speed video tracking systems or opto-electronic motion capture systems report the positions of body segments with respect to time. In the case of high-speed video tracking systems, these data may be acquired from the videotape by means of digitization. In opto-electronic systems, however, markers may be coupled to the individual's body to obtain kinematic data.

In some embodiments, the marker system employed to obtain an individual's kinematic data may be an active marker system or a passive marker system. An active marker system, as referred to herein, may be defined as the system where the markers, coupled to the individual's body are tracked by a camera sensor that scans signals from infrared light-emitting diodes. On the other hand, a passive marker system, as referred to herein, may be defined as a system where the video capture unit serves as both the source and the recorder of infrared light that is reflected from a retro-reflective marker.

In some embodiments, the reflective markers 1610 track marker velocity during the movement, relative to the anchoring markers placed on the individual's body, for example, on the sternum and ribcage. The anchoring markers may be used as reference markers to determine the change in position of the reflective markers. The marker velocity, as used herein, may be defined as the time rate of change of position of any given marker on the individual's body.

In FIG. 16, link stretches 1620 and 1630 represent the distance between the reflective markers 1610, tracking the stress and strain generated in the individual's tissue at any given time interval. In some embodiments, for example, link stretch 1620, represented by a solid line, indicates high velocity and high strain areas, whereas link stretch 1630, represented by a dashed-line, indicates low velocity and low strain areas. The amount of stress and strain generated and the velocity of the reflective markers 1610 may vary depending on the type and intensity of the physical activity being performed by an individual.

In some embodiments, a series of moving images, still snapshots, continuous videos, or a combination thereof may be used to obtain kinematic data and determine the amount of stress and strain and high impact zones, in an individual's body while engaged in a physical activity.

In some embodiments, the molded cup 430 may comprise an untreated layer of nylon spandex, a perforated polyurethane foam, and a mesh liner.

Figure 9:
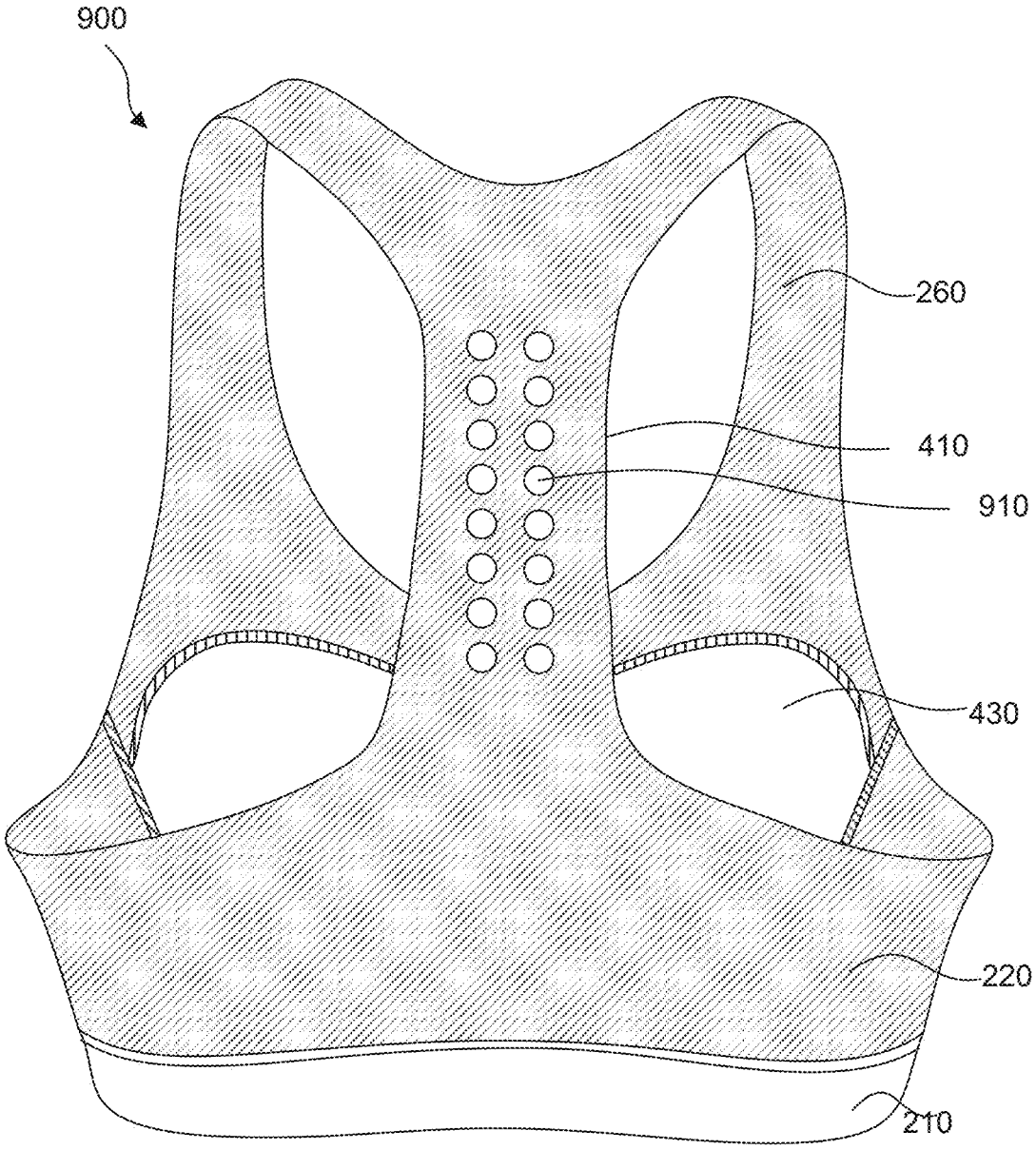
FIG. 9 is a rear view of an STF treated sports bra according to an embodiment.
Figure 10:
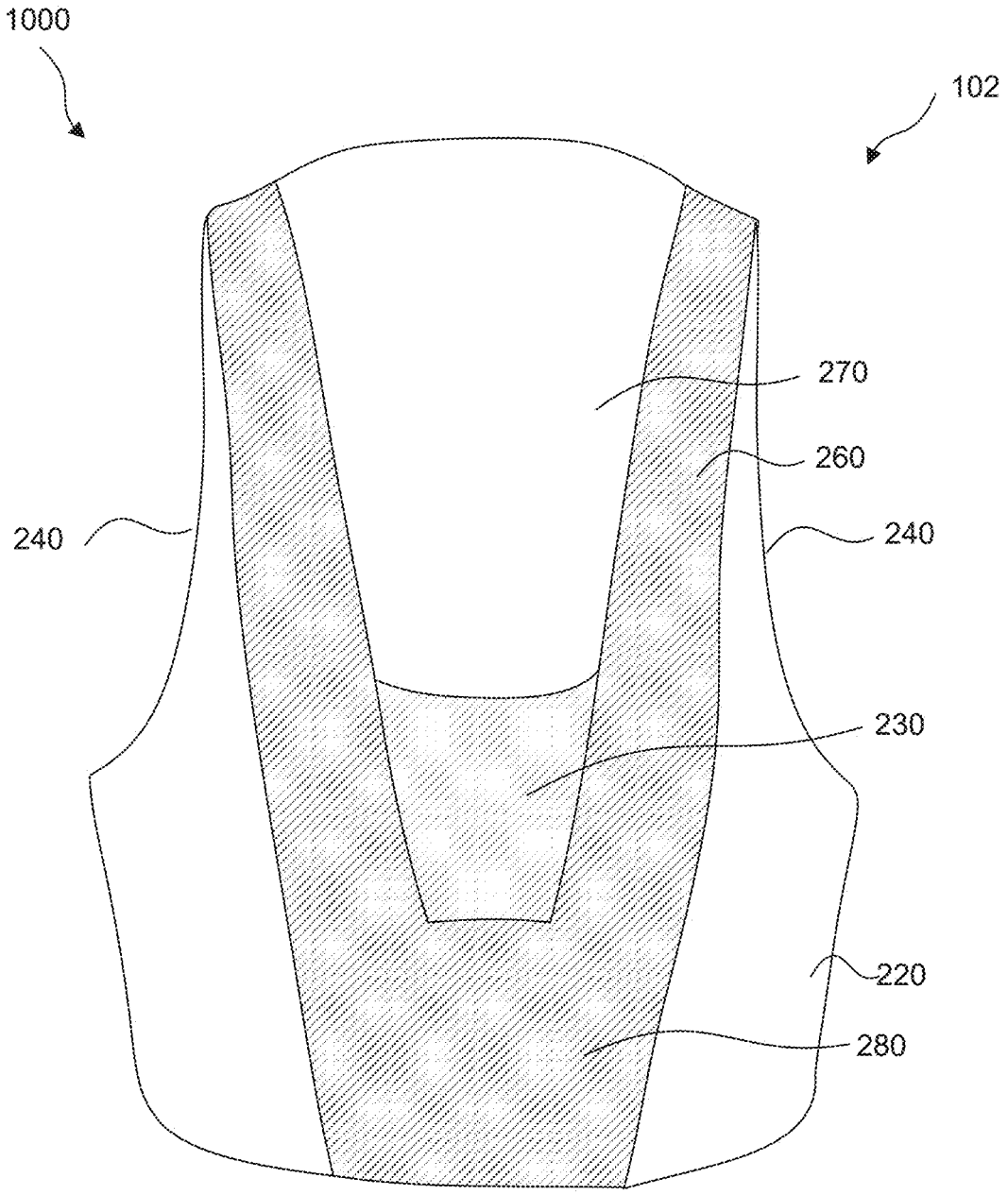
FIG. 10 is a rear view of an STF treated sports bra according to an embodiment.

FIGS. 9 and 10 show rear views 900 and 1000, respectively, of the STF treated movement-reactive sports bra 102. The rear upper end 270 may include a STF treated fabric that extends angularly downward toward the rear lower end 280 on either side of the wearer's spine and anchors at the bottom band 210 to stabilize fabric stretch over shoulder. The rear upper end may also include an untreated fabric to cover a portion of the wearer's posterior torso connecting the shoulder straps configured to stabilize the shoulder straps 260 for maximum support to the wearer's body part during physical activity.

In some embodiments, the side panel 220 may include STF treated fabric at impact locations. The side panel 220 may extend into and seamlessly connect with the bottom band 210 or may be connected by stitching, gluing, zipping, or other suitable means. In some embodiments, the sports bra 102 may not have arm holes 240 but instead comprise sleeves configured to cover a portion of the wearer's arms around the girth of the arms. In some embodiments, the rear section comprising the rear upper end 270 and the rear lower end 280 may not include STF treated fabric.

In some embodiments, as illustrated in FIG. 9, the pair of shoulder straps 260 may converge in the rear upper end 270, merging into a single spine band 410 providing support to at least a portion of the wearer's spine. The spine band 410 may comprise one or more perforations 910 configured to provide breathability. The spine band 410 may connect the rear upper end and the rear lower end in the rear section 206 of the movement-reactive sports bra 102. In some embodiments, the spine band 410 may be partially treated with the STF, entirely treated with the STF, or may not be treated with the STF at all.

In some embodiments, the shear thickening fluid is a suspension that comprises particles dispersed in a fluid medium. The STF may comprise a non-Newtonian fluid that has a shear stress threshold value. The viscosity of the STF as a function of shear stress, increases non-linearly above the shear stress threshold value.

In some embodiments, the shear stress threshold value may be 1 Pa, 2 Pa, 5 Pa, 10 Pa, 20 Pa, 50 Pa, 100 Pa, 200 Pa, 300 Pa, 400 Pa, 500 Pa, 600 Pa, 700 Pa, 800 Pa, 900 Pa, 1000 Pa, or any range having any of these values as endpoints. Other suitable shear stress threshold values may be used.

In absence of shear stress or at lower shear stress than the shear stress threshold value, the colloidal particles may be dispersed in the fluid, neither strongly attract nor repel each other, so that they move freely throughout the liquid medium without clumping together or settling to the bottom. In some embodiments the particles may weakly interact so as to form a weak gel at rest. In other embodiments, the particles may be so concentrated so as to form a glassy-like material at rest. In case of a high shear stress such as a sudden impact or high rubbing forces, the STF will flow and repulsive forces between the particles are overcome and the particles are driven into close proximity to form transient density fluctuations known as hydroclusters. These hydroclusters are transient concentrated regions of particles caused by the high shear stress and dissipate when the shear stress is reduced below the threshold value or the energy from the impact dissipates. This shear stress dependent viscosity behavior is reversible in shear thickening fluids.

The shear stress threshold value and the nature of shear thickening depends on physical parameters of the suspended phase and the suspending phase. Some of the important parameters include, but are not limited to, particle size, particle shape, particle volume, particle surface, particle solubility, viscosity of the suspending phase, surface energy of the suspending phase, and temperature.

In some embodiments, the particles are also referred to as colloidal particles. The particles used in the STF may be generally selected from, but not limited to, silicon dioxide (silica), titanium oxide (titania), calcium carbonate, cornstarch, polymethacrylates, poly (alkyl methacrylates), gum arabic and borate ions, guar gum and borate ions, or combinations thereof. In some embodiments, the particles may be inorganic particles. Other suitable materials may be used.

In some embodiments, the colloidal particles may have an average size of 5 nm, 10 nm, 20 nm, 30 nm, 40 nm, 50 nm, 80 nm, 100 nm, 150 nm, 200 nm, 250 nm, 400 nm, 500 nm, 600 nm, 800 nm, 1 μm, 2 μm, 5 μm, 10 μm, 20 μm, 50 μm, 100 μm or any range having any of these two values as endpoints. Other sizes may be used as well as combination of sizes and polydisperse particles. Preferred ranges include 5 nm to 1 μm, 100 nm to 500 nm, 100 nm to 1 μm.

In some embodiments, the concentration of the particles (by weight) may be 5% or more, 10% or more, 20% or more, 40% or more, 45% or more, 50% or more, 55% or more, 60% or more, 61% or more, 62% or more, 63% or more, 64% or more, 65% or more, 66% or more, 67% or more, 68% or more, 69% or more, 70% or more, 75% or more, 80% or more, 90% or more. Preferred ranges include 55%-65% by weight, 60%-70% by weight, 65%-75% by weight. Other suitable ranges may be used.

In some embodiments, the fluid medium is a fluid generally selected from the group consisting of ethylene glycol, polyethylene glycol, propylene glycol, silicone oil, a modified silicone oil, mineral oil, a hydrocarbon, ionic liquid, or combinations thereof. Other suitable fluids may be used. Some examples of preferred fluid medium are polyethylene glycol and phenylmethyl silicone oil. In some embodiments, the fluid medium is an organic solvent. The solvent should preferably have high stability, high boiling point and non-flammable properties.

In some embodiments, the treated fabric of the article of sportswear when secured on a wearer's body part comprises a first portion in direct contact with the wearer's body part targeted for movement-reactive support and a second portion not in direct contact with the targeted body part. The first portion of the treated fabric in direct contact with the wearer's body part stretches and conforms to the wearer's body part when a shear stress in the first portion of the treated fabric is less than or equal to the shear stress threshold value. In cases where the shear stress in the first portion of the treated fabric is above the shear stress threshold value the first portion of the treated fabric restricts movement of the wearer's body part.

Figure 11:
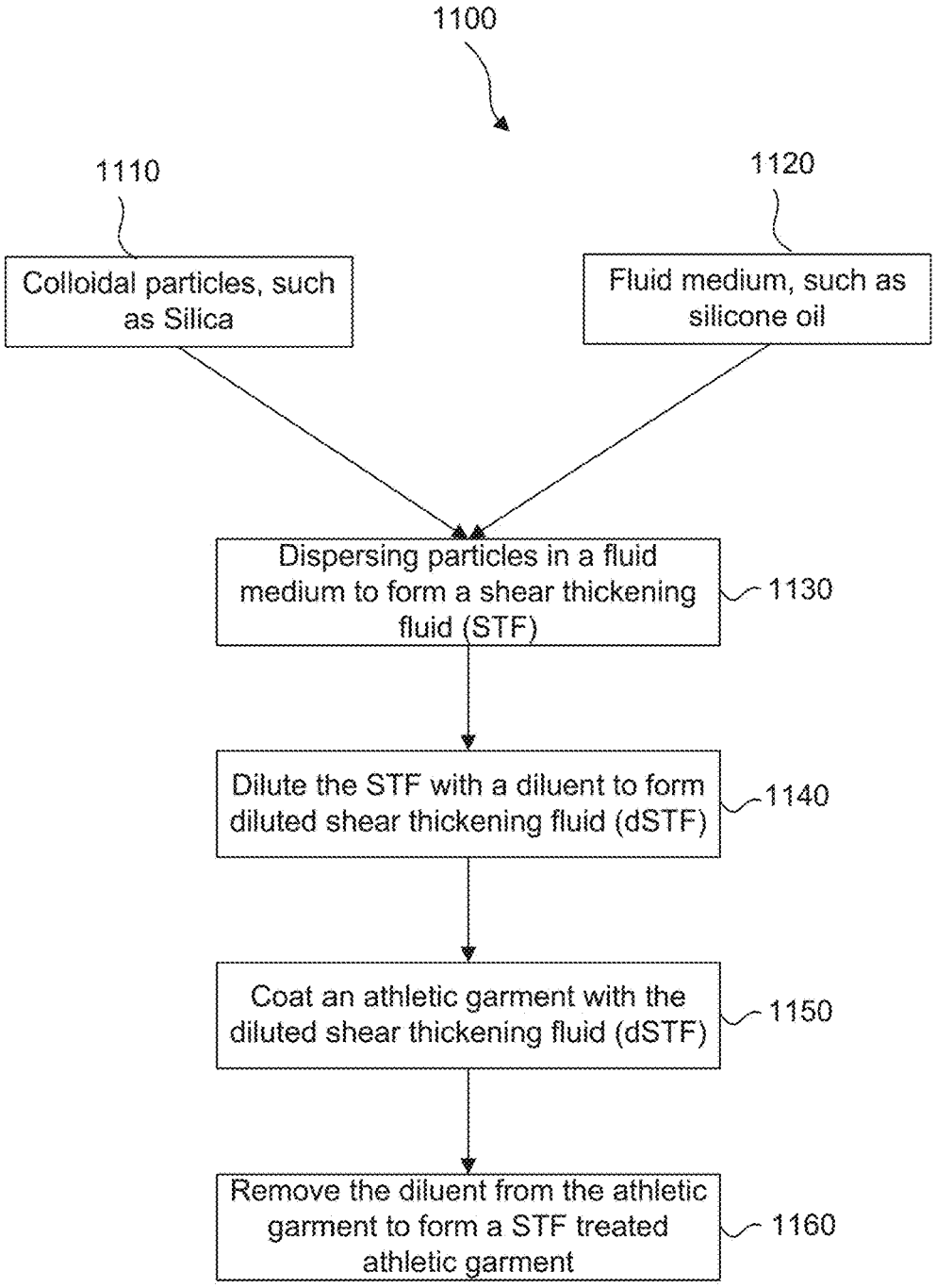
FIG. 11 is a process flowchart of forming a STF treated garment according to an embodiment.

Some embodiments are directed towards a method of treating an athletic garment with a STF, as illustrated by a process flowchart in FIG. 11.

In step 1110, particles such as silica may be prepared. The preparation of particles prior to dispersing in the fluid medium may include pre-treatment of the particles, improving size uniformity and size distribution, surface modification by chemical or physical means, or combinations thereof. Other desirable preparation treatments may be used.

In step 1120, the fluid medium, for example ethylene glycol or modified silicone oil is prepared. The preparation may include adjusting the viscosity of the fluid, temperature of the fluid, homogenizing the fluid if more than one fluids are used, etc. Steps 1110 and 1120 may be performed in no specific order. Steps 1110 and 1120 may be performed sequentially or simultaneously.

In step 1130, a pre-determined amount of particles prepared from step 1110 is dispersed in the fluid medium prepared from step 1120 to form a suspension having a known concentration of the particles. The mixing of particles in the fluid medium may be performed in a double planetary mixer or similar equipment. Dispersing aids such as surfactants, polymers, or other dispersants may be used to aid in dispersing the particles. The suspension formed by the dispersion of particles in the fluid medium comprises a shear thickening fluid.

In step 1140, the prepared shear thickening fluid from step 1130 is diluted by adding a known amount of a diluent to form a diluted shear thickening fluid. The diluent may comprise an alcohol, such as, for example, methanol, ethanol, isopropanol, or methylethylketone (MEK). Other suitable diluents may be used.

In some embodiments, the ratio of diluent to the suspension in the diluted shear thickening fluid may range from 1:1 to 10:1, 1:1 to 8:1, 1:1 to 6:1, 1:1 to 4:1, 1:1 to 2:1, 2:1 to 10:1, 2:1 to 5:1, 2:1 to 4:1, 2:1 to 3:1, 3:1 to 10:1, 3:1 to 5:1, 3:1 to 4:1, 4:1 to 10:1, 4:1 to 5:1, and 5:1 to 10:1. Other suitable ranges may be used. Preferred ranges include 2:1 to 5:1.

In step 1150, a fabric to be used in making an athletic garment is intercalated with the diluted shear thickening fluid. The intercalation may be performed by a variety of techniques including, but not limited to, dipping, rolling, spraying, brushing, or a combination thereof. Other intercalation methods may be used. In one embodiment, the fabric may be dipped in the diluted shear thickening fluid. In some embodiments, individual fibers or yarns of the fabric or athletic garment may be intercalated with the diluted shear thickening fluid prior to being knit or woven into a fabric.

In step 1160, the diluent is removed from the intercalated athletic garment such that the particles in the fluid medium adhere to the fabric to form a STF treated garment. The diluent is typically a volatile alcohol such as ethanol and can be removed by one or more methods including, but not limited to, oven-drying, air-drying, vacuum-drying, or a combination thereof.

Figure 12:
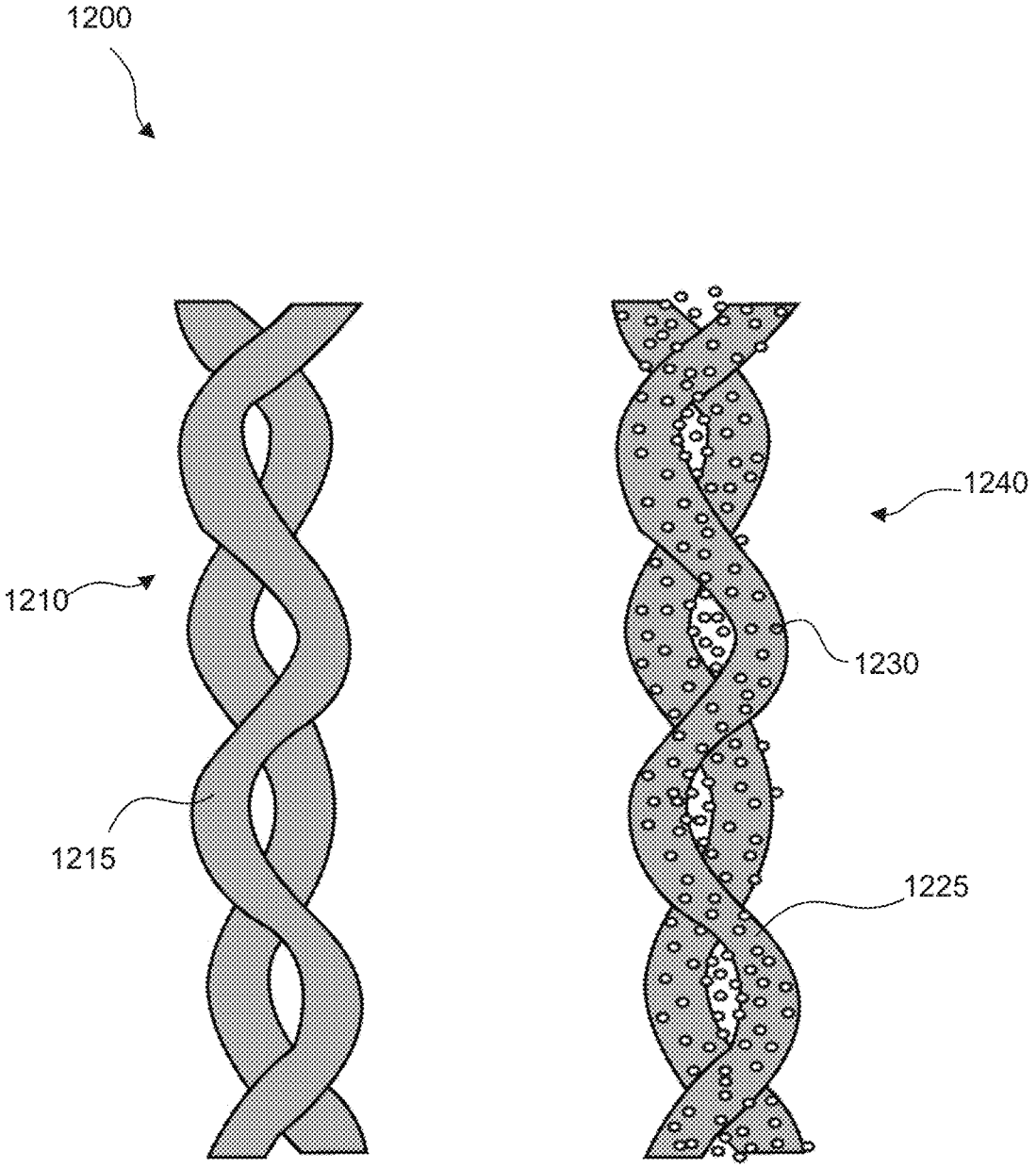
FIG. 12 is a schematic illustration of an untreated and STF treated yarn according to an embodiment.

FIG. 12 illustrates an untreated yarn 1210 and a STF treated yarn 1240. The untreated yarn 1210 may comprise inter-twisted untreated fibers 1215. The STF treated yarn 1240 may be made by inter-twisting STF treated fibers 1225. In some embodiments, the STF treated yarn 1240 may be made by treating untreated inter-twisted fibers 1215 with STF, as described above. The treated fibers 1225 may comprise a treatment of STF fluid 1230. The coverage uniformity of the inorganic STF fluid 1230 on the treated fibers 1225 may depend on process parameters and material properties such as suspension viscosity, concentration, dilution ratio, temperature of the suspension, and homogeneity of the suspension.

Figure 13:
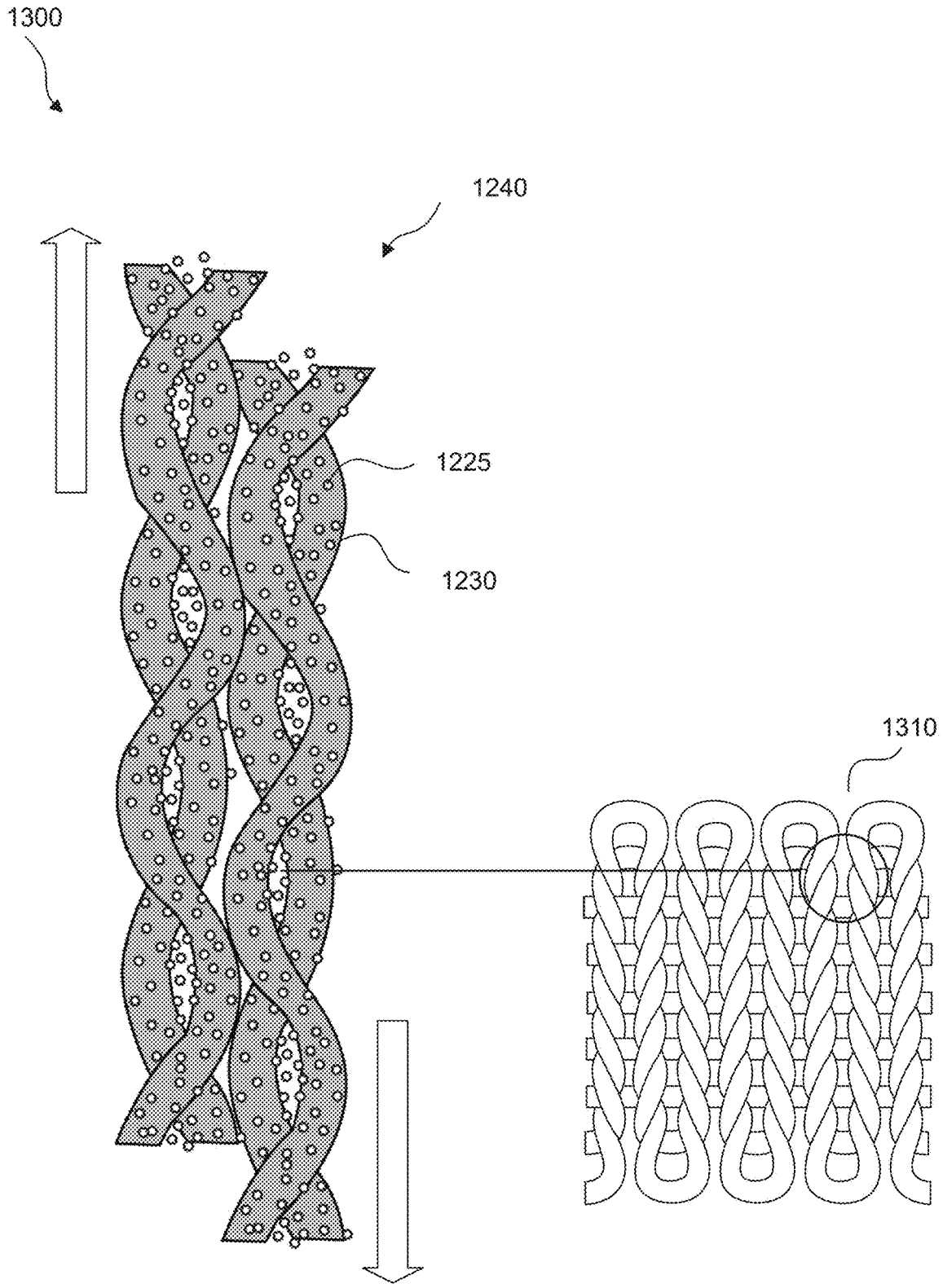
FIG. 13 is a schematic illustration of a STF treated fabric according to an embodiment.

In some embodiments, an STF treated fabric 1310, comprises inter-twisted yarns that may be STF treated, as illustrated in FIG. 13. During fabric manipulation, for example, during physical activity, depicted by the arrows in opposite directions in FIG. 13, the yarns and the fibers undergo shearing. If the shear stress exceeds the shear stress threshold value, the particles in the STF fluid 1230 will form hydroclusters, increasing the viscosity of the STF fluid 1230. This sudden increase in viscosity of the STF fluid 1230 "locks" the fibers and yarns in place by restricting the fibers and the yarns to slide against each other. The transition from a low viscosity fluid to a high viscosity fluid may occur in milliseconds and may be invisible to the naked eye since the particles are nanoparticles. The viscosity of the STF fluid 1230 increases dramatically above the shear stress threshold value, such that at higher levels of physical activity, the restriction of movements may be more significant.

Figure 14:
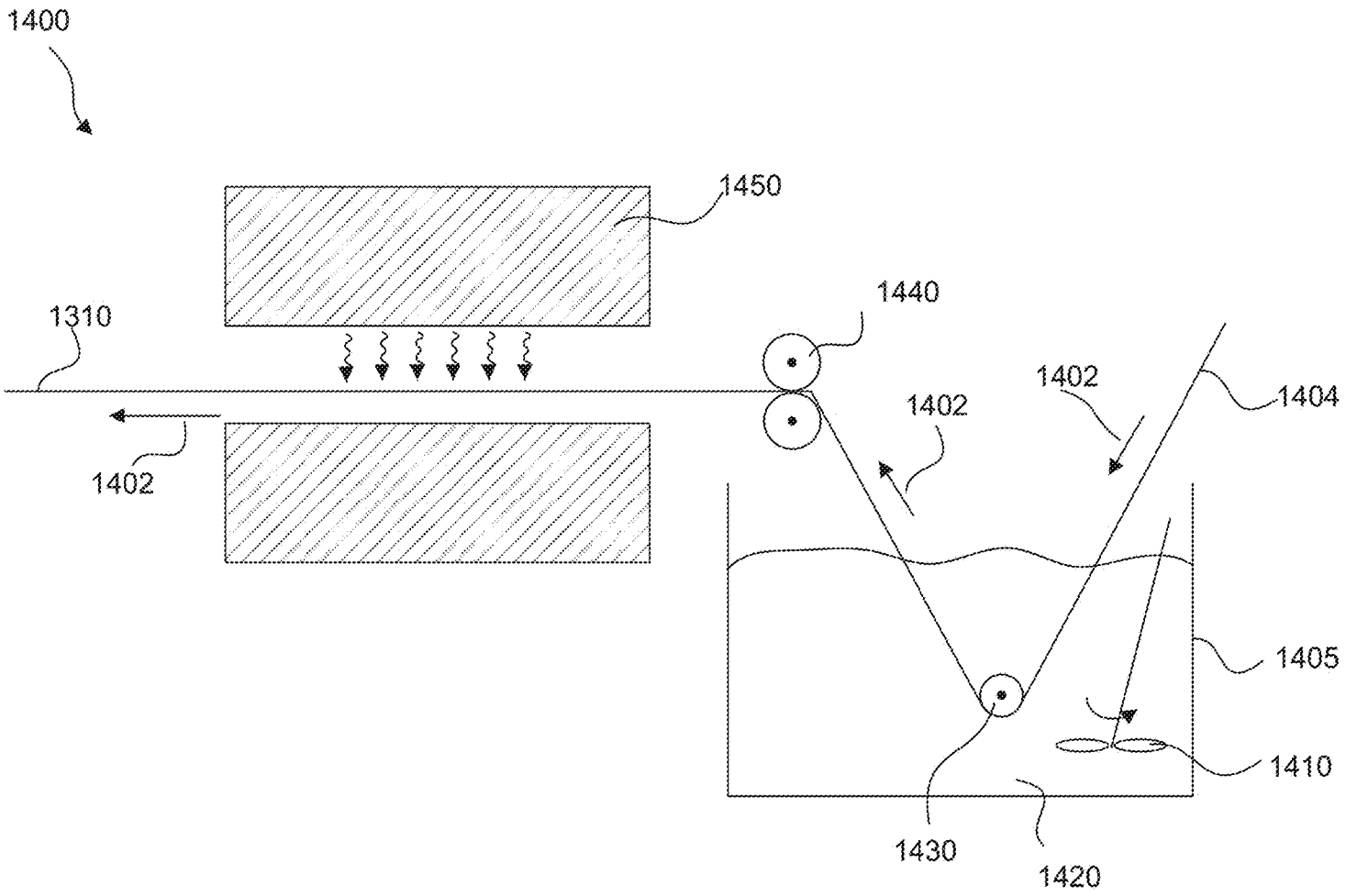
FIG. 14 is a schematic illustration of an apparatus for forming a STF treated fabric according to an embodiment.

Fibers, yarns, a fabric, or a completed athletic garment may be treated with STF by an exemplary apparatus 1400 for forming an STF treated article, shown in FIG. 14. An untreated fabric 1404 passes through an agitated or stirred bath of diluted STF 1420 in a diluted STF tank 1405. The diluted STF 1420 may be constantly stirred with a stirrer 1410. The untreated fabric 1404 may be dipped or continuously fed into the diluted STF tank 1405 containing the diluted STF 1420 while being completely immersed in the diluted STF 1420. The fabric follows a path 1402 through the treating process.

Figure 15:
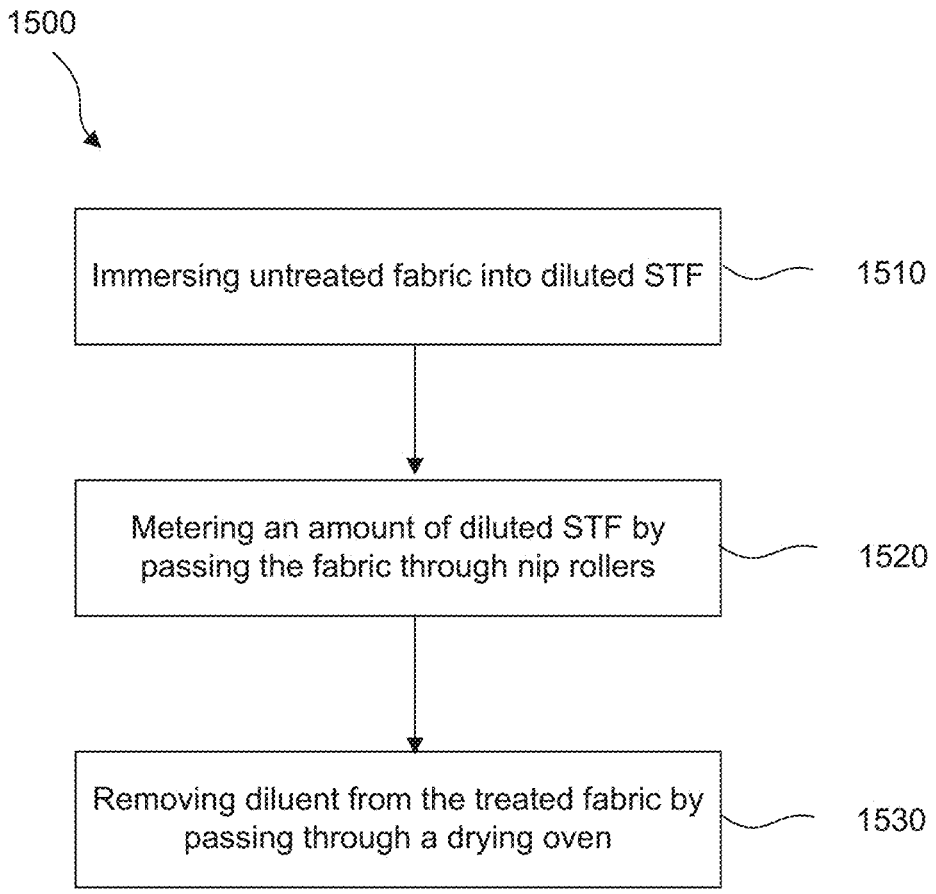
FIG. 15 is a process flowchart for treating a fabric with STF according to an embodiment.

FIG. 15 shows a process flow chart 1500 for treating a fabric with STF. In one embodiment, the process comprises of the following steps in order:

Step 1510: Immersing the untreated fabric into diluted STF.

Step 1520: Metering an amount of diluted fluid by passing the fabric through nip rollers.

Step 1530: Removing diluent from the treated fabric by passing through a drying oven.

In step 1510, the untreated fabric 1404 in an untreated state passes through the diluted STF 1420 toward and around a guard roller 1430 such that the guard roller 1430 ensures complete immersion of the fiber, yarn, fabric or garment in the diluted STF 1420. The diluted STF 1420 may be continuously replenished to maintain an adequate amount of the fluid in the tank 1405. In some embodiments, the temperature of the diluted STF in the tank 1405 may also be maintained or adjusted depending on the quality and amount of STF desired. In some embodiments, the guard roller 1430 may also be used to adjust the pull tension and the feed rate of the incoming untreated fiber, yarn, fabric or garment. The untreated fabric 1404 is intercalated with the diluted STF as it passes in and out of the agitated diluted STF 1420 through the guard roller 1430.

In step 1520, the untreated fabric 1404 passes through nip rollers 1440 to squeeze out the excess fluid from the fabric.

The nip rollers 1440 may be used to meter an amount of the diluted STF 1420 on the fabric treated with the diluted STF. In some embodiments, the nip rollers 1440 may be positioned such that the excess fluid is collected in the diluted STF tank 1405. In some embodiments, the guard roller 1430 and the nip rollers 1440 may be operated mechanically or electrically. Other operation mechanisms may be used. The radius of the guard roller 1430 and the nip rollers 1440 may be individually adjusted based on the material to be treated, the throughput, etc. The guard roller 1430 and the nip rollers 1440 may have a smooth surface or a textured surface configured to enhance traction.

In step 1530, after being treated with the STF, the fabric passes through a drying oven 1450 to remove the diluent, forming the STF treated fabric 1310. In some embodiments, the diluent may be removed by any appropriate means such as oven-drying, air drying, vacuum-drying, or combinations thereof. The temperature of the oven may be maintained such that the diluent evaporates from the diluted STF treated fabric, leaving the STF treated fabric 1310. The STF treated fabric 1310 may be manipulated, for example, by cutting and sewing, to provide the STF treated article of sportswear.

In some embodiments, one or more finishing treatments may be applied to the base fabric, including, but not limited to, stripping, dyeing, finishing, fixing, softening, or any combination thereof to enhance washability, modify the texture or the hand-feel, improve adhesion of the shear thickening fluid, and/or improve performance. In one embodiment, the finishing treatment may be performed prior to the shear thickening fluid treatment.

In some embodiments, the treatment of the fabric may include a specific combination of treatments, for example, a) undyed and unfinished; b) dyed but no fixing agents or fabric softeners applied; c) dye and fixing agents applied but no fabric softeners applied; and d) dye, fixing agents, and fabric softeners applied. Other suitable combinations of treatments may be used. A treatment or a combination of treatments may be chosen depending on the base fabric, desired performance and adhesion, the intended use, etc.

In some embodiments, the dye may be a natural or an artificial dye, an acid dye, a basic dye, a disperse dye, a vat die, or any combination thereof. Other suitable dyes may be used.

In some embodiments, fabric softeners, as referred to herein, may include electrically charged chemical compounds, when applied to a fabric, cause the threads or the fibers to "stand up" from the surface. The fabric softeners may be cationic or anionic fabric softeners.

In some embodiments, fixing agents, as referred to herein, may include chemical compounds that facilitate attachment of dyes, colors, or pigments to the fabric by forming a chemical bond between the fabric and the dye, or color, or pigments. A fixing agent may improve or increase wash/wet fastness and avoid color migration upon exposure to water, detergents, or sun.

In some embodiments, the base yarn and the base fiber may be treated prior to forming a fabric and prior to STF treatment of the fabric. In some embodiments, the base fibers may be treated with finishing treatments and STF treatment prior to forming yarns and fabric, allowing formation of seamless garments or zoned garments. For example, a movement-reactive fabric or a garment may be formed from movement-reactive lycra, polyester, nylon, wool, cotton, fibers or combinations thereof.

Embodiments include various ways to form a movement-reactive STF treated garment. In one embodiment, a fabric may comprise finished and STF treated individual base fibers. The base fibers may be finished and STF treated prior to forming a yarn.

In some embodiments, a yarn may comprise unfinished and untreated individual fibers. The yarn formed from individual base fibers may be finished and STF treated so as to form a STF treated fabric.

In some embodiments, a fabric may comprise yarns that further comprise unfinished and untreated individual fibers. The fabric formed from unfinished and untreated yarn and/or fibers may be finished and STF treated by one or more of the ways described above.

In some embodiments, one or more sections of finished and treated fabric may be coupled for example, by sewing, stitching, gluing, etc. to form a movement-reactive treated garment.

In some embodiments, a finished garment comprising untreated fabric or untreated portions of fabric may be STF treated to form a movement-reactive STF treated garment.

It is to be appreciated that the Detailed Description section, and not the Summary and Abstract sections, is intended to be used to interpret the claims. The Summary and Abstract sections may set forth one or more but not all exemplary embodiments of the present invention(s) as contemplated by the inventor(s), and thus, are not intended to limit the present invention and the appended claims in any way.

The present invention(s) have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention(s) that others can, by applying knowledge within the skill of the art, readily modify and/or adapt for various applications such specific embodiments, without undue experimentation, without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention(s) should not be limited by any of the above-described exemplary embodiments, but should be defined only in accordance with the following claims and their equivalents.

What is claimed is:

1. A method of manufacturing an athletic garment, comprising:

dispersing particles in a fluid medium to form a suspension, wherein the suspension comprises a shear thickening fluid, and wherein the size of the particles ranges from 5 nm to 50 um;

diluting the formed suspension with a diluent to form a diluted shear thickening fluid;

intercalating a fabric with the diluted shear thickening fluid;

removing the diluent from the fabric intercalated with the diluted shear thickening fluid such that the particles in the shear thickening fluid adhere to the fabric; and forming the athletic garment with the fabric.

2. The method of claim 1, wherein the ratio of diluent to the suspension in the diluted shear thickening fluid ranges from 1:1 to 10:1.

3. The method of claim 1, wherein forming the athletic garment comprises at least one of cutting and sewing to provide the athletic garment.

4. The method of claim 1, wherein the athletic garment is a sports bra.

5. The method of claim 1, wherein removing the diluent from the fabric comprises passing the intercalated fabric through a drying oven.

6. A method of treating fabric with a shear thickening fluid, the method comprising:

dispersing particles in a fluid medium to form a suspension, wherein the suspension comprises a shear thickening fluid, and wherein the size of the particles ranges from 5 nm to 50 um;

diluting the formed suspension with a diluent to form a diluted shear thickening fluid;

intercalating the fabric with the diluted shear thickening fluid; and removing the diluent from the fabric intercalated with the diluted shear thickening fluid such that the particles in the shear thickening fluid adhere to the fabric to form the fabric treated with the shear thickening fluid.

7. The method of claim 6, wherein the ratio of diluent to the suspension in the diluted shear thickening fluid ranges from 1:1 to 10:1.

8. The method of claim 6, wherein the fabric is configured for use in an athletic garment.

9. The method of claim 6, wherein removing the diluent from the fabric comprises passing the intercalated fabric through a drying oven.

10. A method of manufacturing a sports bra, comprising:

dispersing particles in a fluid medium to form a suspension, wherein the suspension comprises a shear thickening fluid;

diluting the formed suspension with a diluent to form a diluted shear thickening fluid;

intercalating a portion of a fabric for making a sports bra with the diluted shear thickening fluid;

removing the diluent from the portion such that the particles in the shear thickening fluid adhere to the fabric; and forming the sports bra with the fabric.

11. The method of claim 10, wherein the ratio of diluent to the suspension in the diluted shear thickening fluid ranges from 1:1 to 10:1.

12. The method of claim 10, wherein removing the diluent from the portion comprises passing the fabric through a drying oven.

13. The method of claim 10, wherein a portion of a front section of the sports bra is intercalated with the diluted shear thickening fluid.

14. The method of claim 13, wherein the entire front section is intercalated with the diluted shear thickening fluid.

15. The method of claim 13, wherein a portion of a rear section of the sports bra is intercalated with the diluted shear thickening fluid.

16. The method of claim 15, wherein forming the sports bra comprises connecting the front section and the rear section by at least one of stitching, zipping, gluing, snaps, hook-and eye, and hook-and-loop fastening.

17. The method of claim 10, further comprising:

applying a finishing treatment to the fabric, wherein the finishing treatment is configured to enhance washability of the fabric.

18. The method of claim 10, further comprising:

applying a finishing treatment to the fabric before intercalating the portion with the diluted shear thickening fluid, wherein the finishing treatment is configured to enhance adhesion of the shear thickening fluid to the fabric.

19. The method of claim 10, further comprising:

applying a water-repellant coating to an outer side of the sports bra.

* * * * *